US007317158B2

(12) United States Patent
Yamamoto

(10) Patent No.: US 7,317,158 B2
(45) Date of Patent: Jan. 8, 2008

(54) REPRODUCTION CONTROLLER, REPRODUCTION CONTROL METHOD, PROGRAM FOR THE SAME, AND RECORDING MEDIUM WITH THE PROGRAM RECORDED THEREIN

(75) Inventor: Kentaro Yamamoto, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 214 days.

(21) Appl. No.: 11/048,908

(22) Filed: Feb. 3, 2005

(65) Prior Publication Data

US 2005/0172788 A1 Aug. 11, 2005

(30) Foreign Application Priority Data

Feb. 5, 2004 (JP) ..... 2004-029620

(51) Int. Cl.
*G10H 1/40* (2006.01)
*G10H 7/00* (2006.01)

(52) U.S. Cl. ..... 84/612; 84/611

(58) Field of Classification Search ..... 84/612
See application file for complete search history.

(56) References Cited

U.S. PATENT DOCUMENTS

| | | | | |
|---|---|---|---|---|
| 3,865,001 | A | 2/1975 | Hershey | 84/1.03 |
| 5,159,140 | A * | 10/1992 | Kimpara et al. | 84/600 |
| 5,869,783 | A * | 2/1999 | Su et al. | 84/612 |
| 6,177,775 | B1 * | 1/2001 | Bruington et al. | 318/443 |
| 7,053,288 | B2 * | 5/2006 | Iwai et al. | 84/600 |
| 7,053,289 | B2 * | 5/2006 | Iwai et al. | 84/600 |
| 2004/0003706 | A1 * | 1/2004 | Tagawa et al. | 84/609 |

FOREIGN PATENT DOCUMENTS

| | | |
|---|---|---|
| EP | 1 378 912 A2 | 1/2004 |
| WO | WO 93/22762 | 11/1993 |

OTHER PUBLICATIONS

Press Information by Bosch in Japan; disclosed at their website http://www.bosch.co.jp/jp/press/rbjp_011024_3.html; 3 Sheets; Jan. 20, 2004./Discussed in the specification.

M. Goto; "A Real-time Music Scene Description System: A Chorus-Section Detecting Method;" Information Processing Society of Japan, Musical Information Science Study Group; vol. 2002; No. 100; pp. 27-34 (7 Sheets total); Oct. 2002./Discussed in the specification.

European Search Report of Jun. 21, 2005.

* cited by examiner

*Primary Examiner*—Lincoln Donovan
*Assistant Examiner*—Andrew Millikin
(74) *Attorney, Agent, or Firm*—Kratz, Quintos & Hanson, LLP

(57) ABSTRACT

The sound reproducer (100) generates and outputs, when any external situation such as a running sound is recognized by an external input rhythm detecting section (110), generates external rhythm information concerning the recognized running sound. When the external rhythm information is acquired, a rhythm setting section (173) of a processing section 170) generates set rhythm information for setting a rhythm of a music corresponding to the rhythm of the running sound. Because of this feature, even when a running state of the vehicle changes, the sound reproducer (100) can reproduce a rhythm of a music with a rhythm corresponding to the running state. Because of this feature, the music can be reproduced in better conditions in correspondence to the external situation.

16 Claims, 14 Drawing Sheets

FIG. 10

| OBJECT | RECOGNITION START TIME | FRAME-OUT TIME |
|---|---|---|
| WHITE LINE A | 0sec | 0. 5sec |
| WHITE LINE B | 0. 2sec | 0. 9sec |
| WHITE LINE C | 0. 5sec | 1. 5sec |

REPRODUCTION CONTROLLER, REPRODUCTION CONTROL METHOD, PROGRAM FOR THE SAME, AND RECORDING MEDIUM WITH THE PROGRAM RECORDED THEREIN

BACKGROUND OF THE INVENTION

1. Field of the Invention

The present invention relates to a reproduction controller for controlling reproduction of music, a control method for controlling reproduction of music, a program for the same, and a recording medium with the program recorded therein.

2. Description of Related Art

Most vehicles, each as a moving body, have a wiper for securing a view field for a driver by removing rain drops or the like deposited on a front window glass sheet. There has been known a mechanism for controlling movement of the wiper. The mechanism disclosed in this document detects strength of rainfall with a rain drop sensor and drives the wiper with a speed corresponding to the detected strength of rainfall.

Some of the vehicles, each as a moving body, have a sound reproducer for reproducing music recorded, for instance, in a recording medium such as a CD (Compact Disc) or a MD (Mini Disc). The conventional type of sound reproducer improves a driving environment by reproducing music based on data concerning rhythms or tempos of various music works. With the conventional type of sound reproducer, however, a music is reproduced according to the rhythm and tempo of the music ignoring the driving situation, and therefore realization of more comfortable driving environment according to the driving state is desired.

SUMMARY OF THE INVENTION

A main object of the present invention is to provide a reproduction controller capable of executing excellent processing according to external situations, a method for the same, a program for the executing the method, and a recording medium with the program recorded therein.

An aspect of the present invention is to provide a reproduction controller for controlling reproduction of a music, the reproduction controller including: a situation information generating section for recognizing an external situation, generating external rhythm information from information concerning this recognized external situation, and outputting the external rhythm information; and a rhythm setting section for setting a reproduction rhythm of the reproduced music to the rhythm corresponding to the external situation based on the external rhythm information.

Another aspect of the present invention is to provide a reproduction controller for controlling reproduction of a music, the reproduction controller including: a situation information generating section for recognizing an external situation, generating external information concerning this recognized external situation, and outputting the external information; and a rhythm setting section for setting a state in which reproduction of a specific portion having a tune different from that of a portion already having been reproduced of the music is started based on the external information.

A further aspect of the present invention is to provide a reproduction control method for controlling reproduction of a music, the method comprising the steps of: recognizing an external situation, generating external rhythm information from information concerning this recognized external situation, and outputting the external rhythm information; and setting a reproduction rhythm of the reproduced music to the rhythm corresponding to the external situation based on the external rhythm information.

Still another aspect of the present invention is to provide a reproduction control method for controlling reproduction of a music, the method comprising the steps of: recognizing an external situation, generating external information concerning this recognized external situation, and outputting the external information; and setting a state in which reproduction of a specific portion having a tune different from that of a portion already having been reproduced of the music is started based on the external information.

Still another aspect of the present invention is to provide a reproduction control program making a computing section to function as aforesaid reproduction controllers.

Still another aspect of the present invention is to provide a reproduction control program executing aforesaid reproduction control methods by a computing section.

Still another aspect of the present invention is to provide a recording medium with a reproduction control program recorded therein, wherein aforesaid reproduction control programs are stored in a readable state with a computing section.

BRIEF DESCRIPTION OF THE DRAWINGS

FIG. 4A is a schematic view showing a running image screen provided when a white line is recognized, while FIG. 4B is a schematic view showing a running image screen provided when another white line is recognized;

FIG. 5A is a schematic view showing a position of the vehicle before a scene is changed, while FIG. 5B is a schematic view showing a position of the vehicle when the scene is changed;

FIG. 10 is a view showing an example of white line recognition starting time and frame-out time in the embodiment above;

DETAILED DESCRIPTION OF PREFERRED EMBODIMENT(S)

Figure 1:
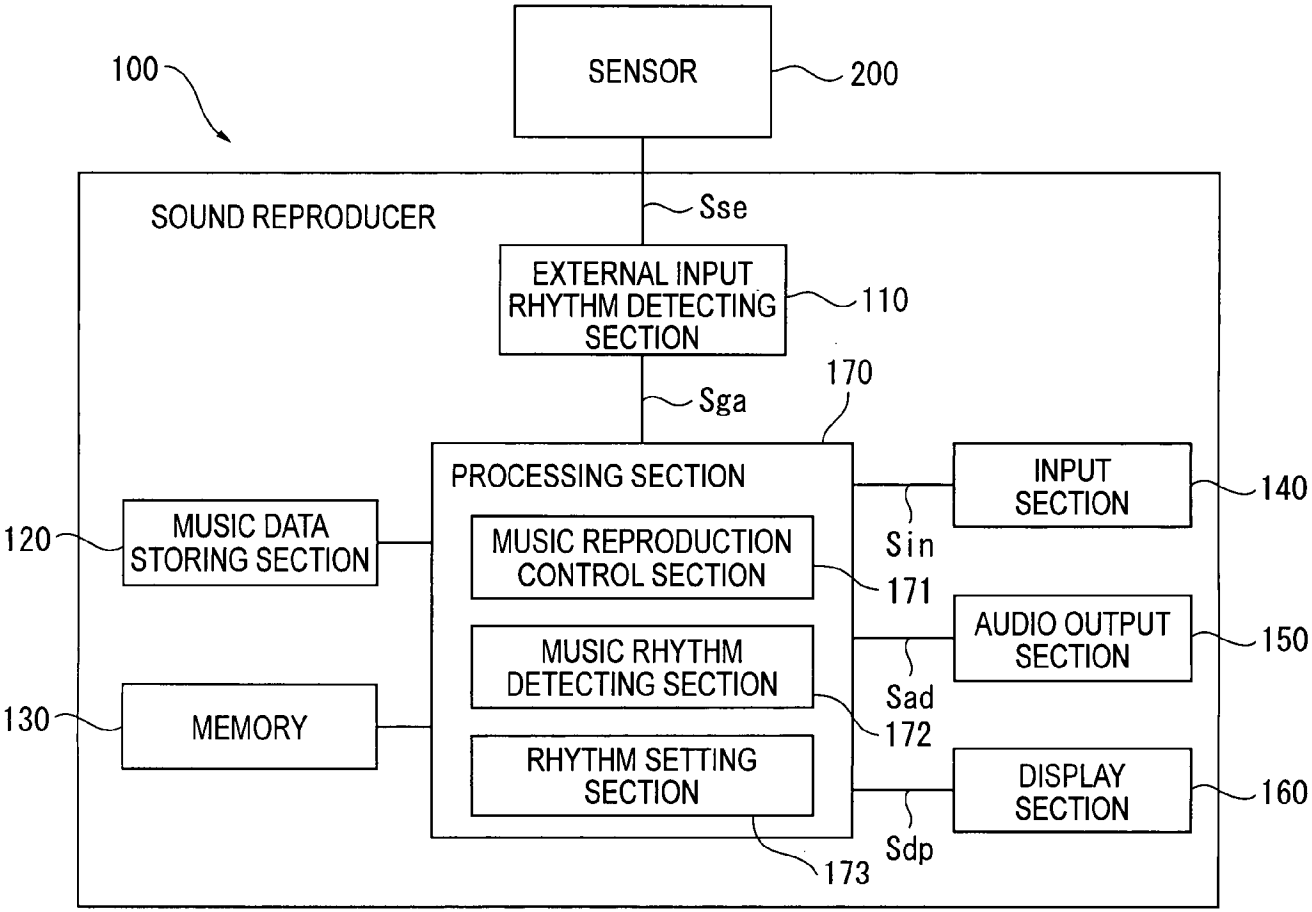
FIG. 1 is a block diagram showing the general configuration of a sound reproducer according to an embodiment of the present invention.
Figure 2:
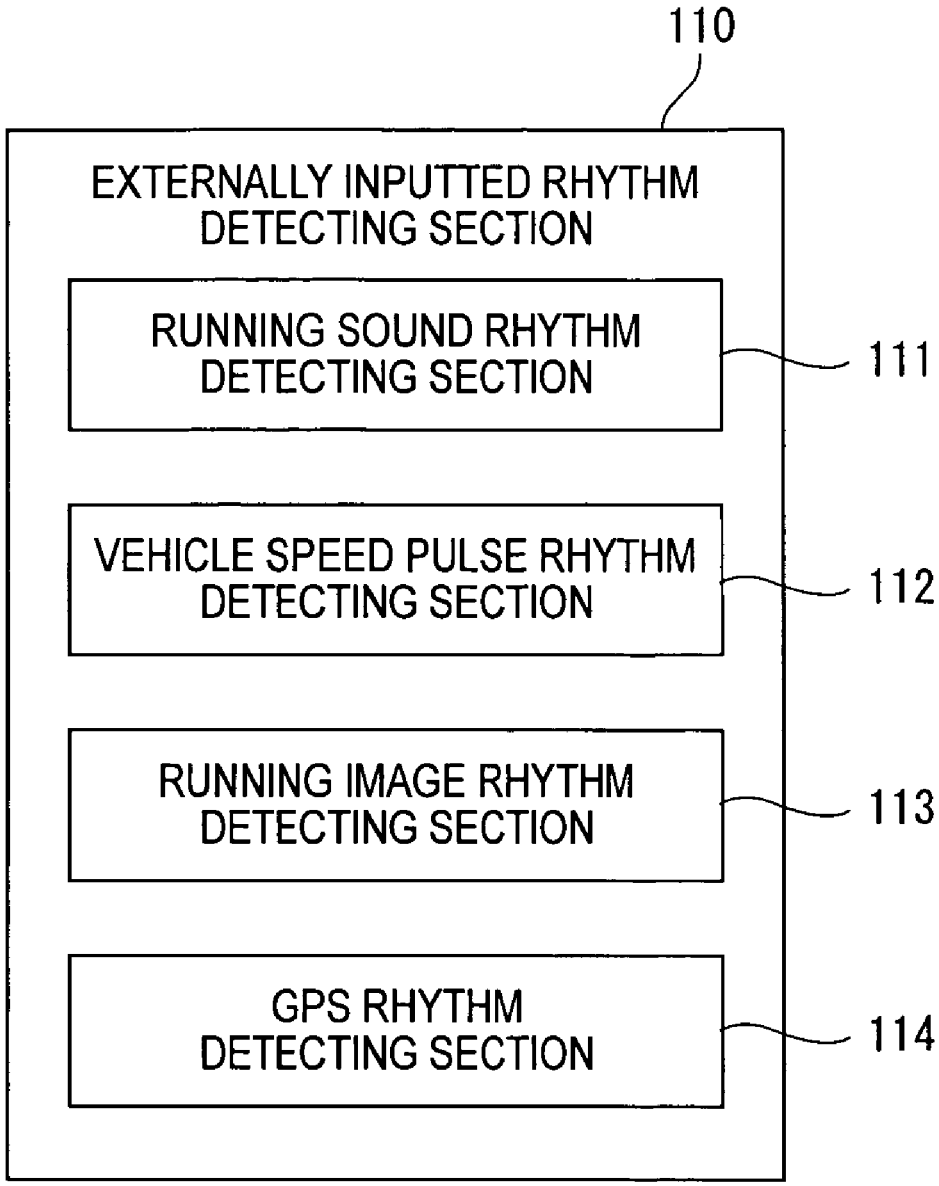
FIG. 2 is a block diagram showing the general configuration of an externally inputted rhythm detecting section in the embodiment above.
Figure 3:
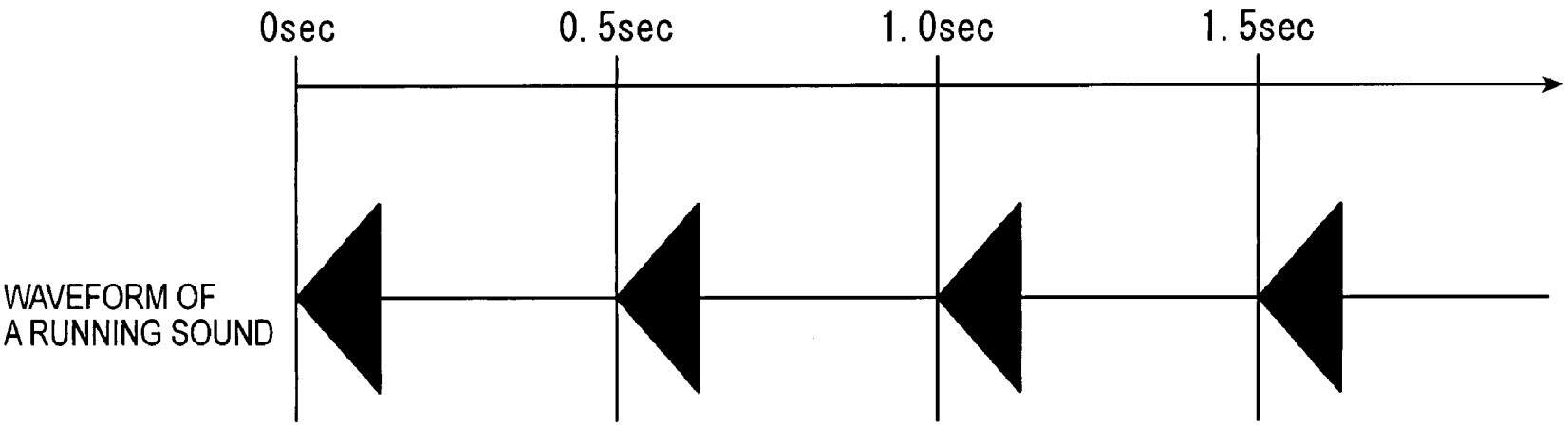
FIG. 3 is a timing chart showing one example of a waveform of running sound in the embodiment above.
Figure 4A:
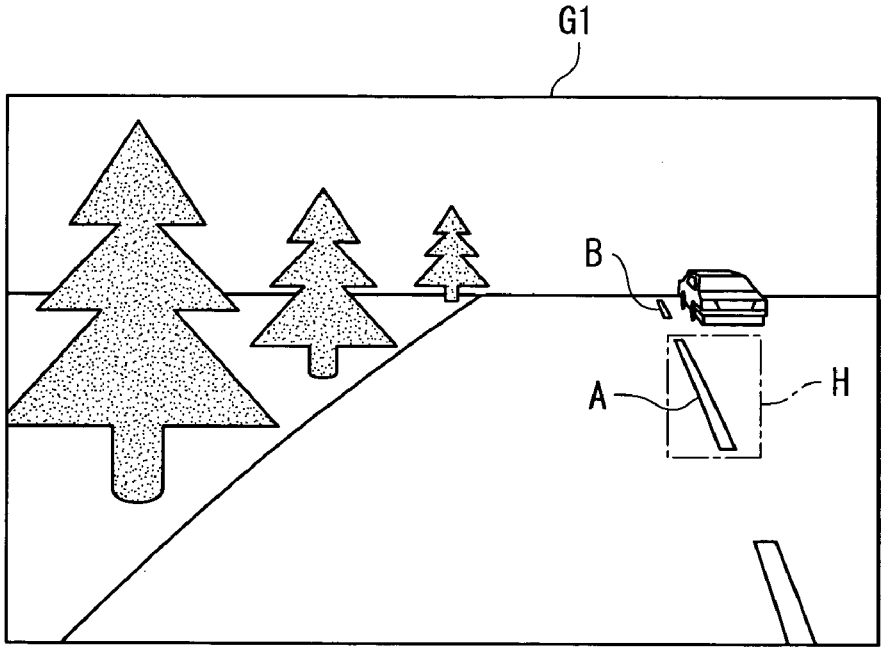
FIG. 4A and FIG. 4B are schematic views each showing an example of a running image screen in the embodiment above, and more specifically.
Figure 4B:
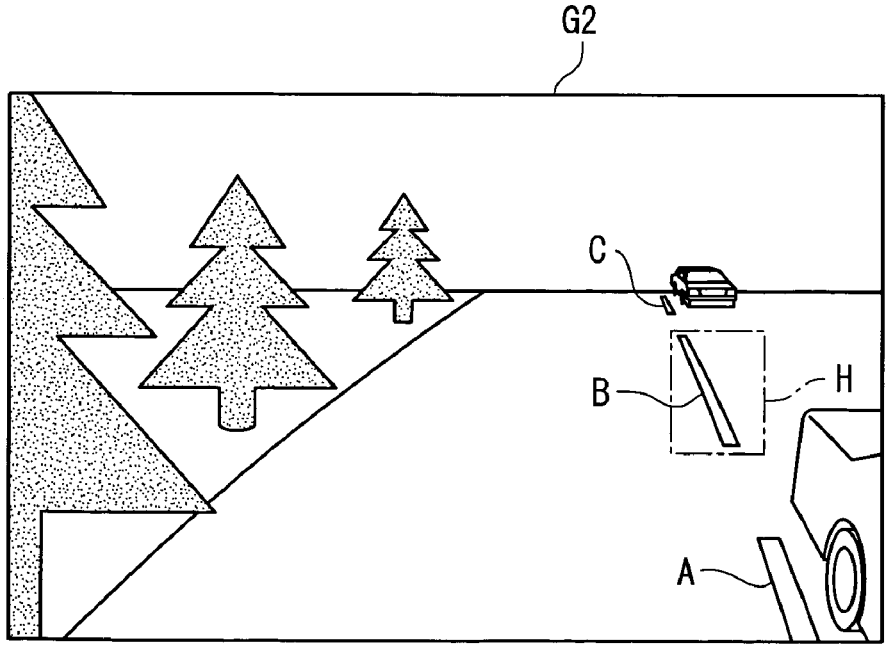
Figure 5A:
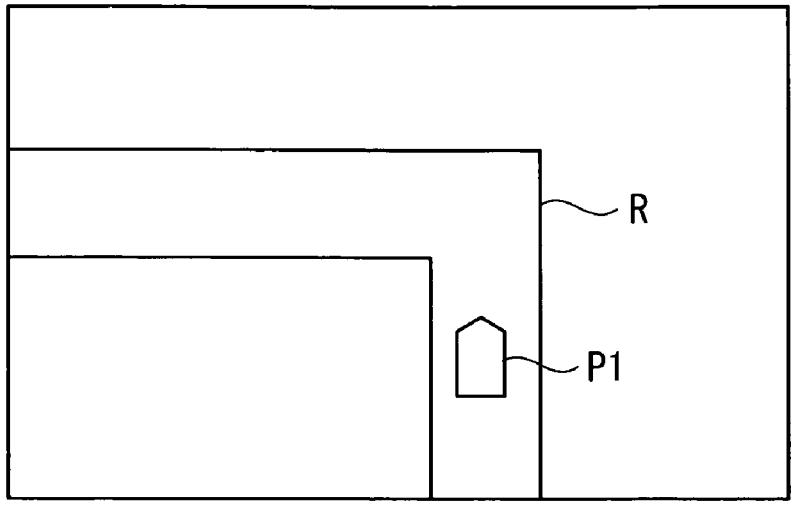
FIG. 5A and FIG. 5B are schematic views each showing an example of a position and a route of a vehicle in the embodiment above, and more specifically
Figure 5B:
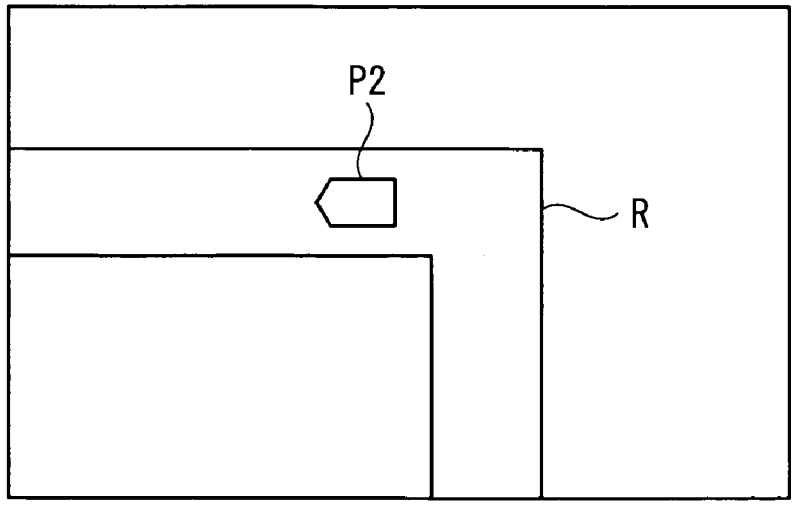
Figure 6:
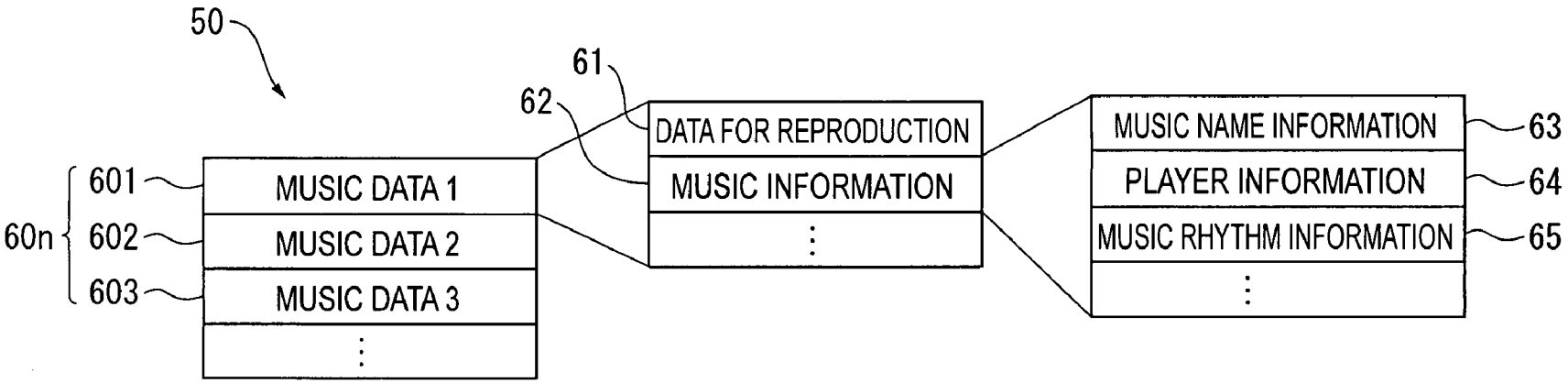
FIG. 6 is a concept view schematically showing a tabular structure of data in music information for reproduction in the embodiment above.

An embodiment of the present invention is described below with reference to the drawings. This embodiment is described below with reference to a sound reproducer comprising a reproduction controller according to the present invention as an example, but the present invention is not limited to this configuration, and is applicable to any configuration in which a music is reproduced. FIG. 1 is a block diagram showing the general configuration of the sound reproducer. FIG. 2 is a schematic view showing the general configuration of a externally inputted rhythm detecting section. FIG. 3 is a timing chart showing an example of a waveform of running sound. FIG. 4A and FIG. 4B are views each showing an example of a running image screen, and FIG. 4A is a schematic view showing a running image screen when a white line is recognized, while FIG. 4B is a schematic view showing a running image screen when another white line is recognized. FIG. 5A and FIG. 5B are schematic views each showing an example of a position and a route of a vehicle, and more specifically FIG. 5A is a schematic view showing a position of the vehicle before a scene is changed, while FIG. 5B is a schematic view showing a position of the vehicle when the scene is changed. FIG. 6 is a concept view schematically showing a tabular structure of data in music information for reproduction.

[Configuration of the Sound Reproducer]

In FIG. 1, the reference numeral 100 indicates an on-vehicle sound reproducer (described as a car audio system hereinafter). This car audio system 100 is a device mounted, for instance, in a vehicle as a moving body, and is used for reproducing music stored with the MIDI (Musical Instrument Digital Interface) format or the WAVE format or those recorded in a CD (Compact Disc) and a MD (Mini Disc). The moving body is not limited to a vehicle, and airplanes and vessels are also objects for application of the present invention. The car audio system 100 comprises an externally inputted rhythm detecting section 110, a music data storing section 120, a memory 130, an input section 140, an audio output section 150, a display section 160, and a processing section 170.

The externally inputted rhythm detecting section 110 recognizes external situations, and generates external rhythm information also functioning as external information concerning the recognized external situations. Then the externally inputted rhythm detecting section 110 outputs the external rhythm information to the processing section 170. The external situations include, but not limited to, a running sound associated with running of a vehicle, rotation of an axle or wheels, and change of landscapes. The term "external" as used herein indicates outside of a casing (not shown) for the car audio system 100. Connected to this externally inputted rhythm detecting section 110 are a sensor 200, a running image pick-up camera (not shown), and a navigation system (also not shown). The sensor 200 detects the external state, and generates a sensor signal Sse describing information concerning the detected state. Then the sensor 200 outputs this sensor signal Sse to the externally inputted rhythm detecting section 110. This sensor 200 comprises a running sensor (not shown), and a speed sensor (also not shown). The running sensor detects a running sound generated in association with running of a vehicle as noises. The running sound includes, but not limited to, those generated due to vibration of the vehicle during running, and those generated due to a change in the air pressure when running against another vehicle. Descriptions herein assume a case in which a running sound associated with running of a vehicle is detected, but the present invention is not limited to this configuration, and also the configuration may be employed in which a sound due to a change in air pressure generated when a vehicle is parking and another vehicle runs by is detected. The running sensor outputs the sensor signal Sse describing the running sound information concerning the running sound to the externally inputted rhythm detecting section 110. The speed sensor detects, for instance, a vehicle speed pulse outputted in association with rotation of an axle or wheels. The speed sensor outputs the sensor signal Sse describing vehicle speed pulse information concerning the vehicle speed pulse to the externally inputted rhythm detecting section 110. The running image pick-up camera picks up running images. The running image pick-up camera then outputs an image signal describing running image information concerning the running image to the externally inputted rhythm detecting section 110. The navigation system executes route search from time to time according to the necessity. Then the navigation system outputs a route signal describing the route-related information concerning a route or a position of the vehicle to the externally inputted rhythm detecting section 110. The externally inputted rhythm detecting section 110 comprises, as shown in FIG. 2, a running sound rhythm detecting section 111, a vehicle speed pulse rhythm detecting section 112, a running image rhythm detecting section 113, and a GPS (Global Positioning System) rhythm detecting section 114.

The running sound rhythm detecting section 111 acquires the sensor signal Sse describing running sound information from the running sound sensor of the sensor 200 from time to time. Then, based on the running sound information of this sensor signal Sse, the running sound rhythm detecting section 111 generates, for instance, external rhythm information concerning rhythms such as BPM (beats per minute) beat, bar, and battuta of the running sound. More specifically, the running sound rhythm detecting section 111 recognizes, for instance, a wave form of the running sound as shown in FIG. 3 indicating the change from inaudible state to audible state of any running sound based on the running sound information from the sensor 200. Then the running sound rhythm detecting section 111 recognizes that a peak interval of the waveform of the running sound is 0.5 second. Then the running sound rhythm detecting section 111 determines based on this peak interval, for instance, that BPM of this running sound is 120. Further the running sound rhythm detecting section 111 generates external rhythm information in which the BPM of this running sound or the like is described. Then the running sound rhythm detecting section 111 converts this external rhythm information to an external rhythm signal Sga, and outputs the signal Sga to the processing section 170.

The vehicle speed pulse rhythm detecting section 112 acquires the sensor signal Sse describing the vehicle speed pulse information from a speed sensor in the sensor 200 from time to time. The following descriptions assume the configuration in which the sensor signal Sse describing the vehicle speed pulse information is acquired from the sensor 200, but the present invention is not limited to this configuration, and for instance the configuration may be employed in which the sensor signal Sse is acquired from a sensor section (not shown) in the navigation system. Then the vehicle speed pulse rhythm detecting section 112 generates external rhythm information concerning rhythms such as BPM, beat, bar, and battuta of the running sound based on the vehicle speed pulse information in the sensor signal Sse. More specifically, the vehicle speed pulse rhythm detecting section 112 recognizes, for instance, a waveform of the vehicle speed pulse based on the vehicle speed pulse information from the sensor 200. Then the vehicle speed pulse rhythm detecting section 112 recognizes a peak interval in the waveform of the vehicle speed pulse. Further the vehicle speed pulse rhythm detecting section 112 recognizes BPM of the vehicle speed pulse from the peak interval. The vehicle speed pulse rhythm detecting section 112 further generates external rhythm information describing BPM or the like of the vehicle speed pulse. Then the vehicle speed pulse rhythm detecting section 112 converts the external rhythm to an external rhythm signal Sga and outputs the external rhythm signal Sga to the processing section 170.

The running image rhythm detecting section 113 acquires an image signal describing running image information from a running image pick-up camera from time to time. The running image rhythm detecting section 113 generates external rhythm information concerning rhythms for recognizing, for instance, an object as an event based on the running image information described in this image signal. More specifically, the running image rhythm detecting section 113 determines whether the object has changed from the invisible state to the visible state or not, namely whether the object has been visually recognized or not based on the running image information described in the image signal. For instance, the running image rhythm detecting section 113 recognizes, for instance, the running image screens G1, G2 as shown in FIG. 4A and FIG. 4B respectively, based on the running image information. Then the running image rhythm detecting section 113 determines whether, for instance, white lines A, B and the like each as an object are present in an object recognition range H in each of the running image screens G1, G2 or not. The object to be recognized includes, but not limited to, for instance, a roadside tree and a building in addition to the white lines A, B, C on a road. When it is determined that, for instance, the white line A is recognized, the running image rhythm detecting section 113 recognizes the point of time when the white line A is recognized as the reference time by referring to a clock unit (not shown). Then the running image rhythm detecting section 113 recognizes elapsed time from the reference time when each of any number of white lines, for instance, three white lines A, B, C by referring to the clock unit (described as object recognition time hereinafter). In addition, the running image rhythm detecting section 113 recognizes the elapsed time from the reference time (described as frame out time hereinafter) when each of the white lines A, B, C changes from the visible state to the invisible state, namely when each of the white lines A, B, C disappears from the running image screens G1, G2 (described as frame out hereinafter). Then the running image rhythm detecting section 113 recognizes a time interval of the object recognition times or frame out times for the white lines A, B, C. The running image rhythm detecting section 113 further recognizes, for instance, BPM which is a rhythm in object recognition from the recognized time interval. Then the running image rhythm detecting section 113 generates external rhythm information describing, for instance, the BPM or the like. Then the running image rhythm detecting section 113 converts the external rhythm information to an external rhythm signal Sga and outputs the external rhythm signal Sga to the processing section 170.

The GPS rhythm detecting section 114 acquires a route signal describing route-related information from the navigation system. The GPS rhythm detecting section 114 generates external rhythm information concerning, for instance, rhythms in changes of a scene as an event such as right-hand turn, left-hand turn, running on a highway, through a tunnel, or over a bridge based on the route-related information described in this: route signal. More specifically the GPS rhythm detecting section 114 determines, based on the route-related information in the route signal, whether the scene is about to be switched or not. For instance, the GPS rhythm detecting section 114 recognizes, for instance, a route R for or a position P1 of a vehicle as shown in FIG. 5 based on the route-related information. When it is determined that there is a left-hand turn point in the route R, namely that there is a point where the scene changes, the GPS rhythm detecting section 114 recognizes the time until the vehicle moves to, for instance, the position P2 as shown in FIG. 5B indicating a rhythm of changes in the scene. In order to recognize this elapsed time, a travel from the position P1 to the position P2 is recognized based on the route-related information. Or, a moving speed of the vehicle is recognized based on the speed pulse information, for instance, from the speed sensor in the sensor 200 or a sensor section in the navigation system. Further the method may be employed in which a period of time required for moving to the position P2 is computed from the recognized travel and the moving speed, but the present invention is not limited to the methods as described above. In a case where a VICS (Vehicle Information Communication System) receiving section (not shown) for acquiring traffic information is provided in the navigation system, the configuration may be employed in which a period of time until the scene is changed is computed by taking into consideration the traffic information acquired by the VICS receiving section. The GPS rhythm detecting section 114 generates external rhythm information describing the period of time until the vehicle moves to the position P2 where the scene is changed or the like and the external rhythm information indicates a rhythm in changes of the scene. Then the GPS rhythm detecting section 114 converts the external rhythm information to an external rhythm signal Sga and outputs the external rhythm signal Sga to the processing section 170.

Hereafter, in each respectively rhythm detecting sections 111, 112, 113, and 114, a rhythm of running sounds, a rhythm of vehicle speed pulses, a rhythm of object recognitions and a rhythm of change in scenes are generically described as an external rhythm.

The music data storing section 120 stores music information for reproduction 50 as shown in FIG. 6 so that the information can be read out from time to time according to the necessity. The music data storing section 120 includes a drive or a driver capable of storing various types of information in various types of recording media such as, for instance, a magnetic disk such as a HD (Hard Disk), an optical disk such as a CD, an MD, or a DVD (Digital Versatile Disc), a magnetic optical disk, a memory card in the readable state.

The music information for reproduction 50 is information concerning music to be reproduced. The music information for reproduction 50 is information having a tabular structure in which a plurality of music data 60*m* (m: natural number) is stored as one data structure.

The music data 60*m* is information concerning one music. The music data 60*m* has a tabular structure in which data for reproduction 61, music information 62 and the like are configured as one data structure. Incidentally, the music data 60*m* may be configured with a structure in which the music information 62 and the like are not stored and only the data for reproduction 61 is stored.

The data for reproduction 61 is used for reproducing a music. The data for reproduction 61 is those recorded, for instance, with the MIDI format or WAVE format so that the music can be reproduced. The music reproduced from the data for reproduction 61 may be recorded with the monophonic format or the stereo format.

The music information 62 is information concerning a music to be reproduced from the data for reproduction 61. The music information 62 has a tabular structure in which music name information 63, player information 64, and music rhythm information 65 and the like are compiled into one data structure. Incidentally, the music information 62 may have the configuration in which at least one of the various types of information 63, 64, 65 and the like is stored.

The music name information 63 is prepared by converting a name of the music into data. The player information 64 is prepared by converting information indicating a player of the music into data. The music rhythm information 65 is prepared by converting, for instance, BPM as peak interval information or information indicating a rhythm of the music such as beat to data.

The memory 130 stores therein, for instance, various types of programs developed on an OS (Operating System) for controlling operations of the entire car audio system 100. It is preferable to use, as the memory 130, a memory capable of maintaining data stored therein even when power is suddenly disconnected, for instance, due to a power failure such as a CMOS (Complementary Metal-Oxide Semiconductor). Incidentally, the memory 130 may comprise a drive or a driver capable of storing data in a recording medium such as an HD, a DVD, an optical disk, or a memory card so that the data can be read out therefrom.

The input section 140 has various types of operation buttons or knobs (not shown) and used for input operations. Contents inputted with the operation buttons or operation knobs are, for instance, matters for setting contents of operations of the entire car audio system 100. More specifically, the inputted matters include those for setting such as start and stop of reproduction of a music, adjustment of volume, or for setting to drive any one of the rhythm detecting sections 111, 112, 113, and 114. In the following descriptions, the state in which only the running sound rhythm detecting section 111 is operated is described as the running sound detection mode, the state in which only the vehicle speed pulse rhythm detecting section 112 is operated as the vehicle speed detection mode, the state in which only the running image rhythm detecting section 113 is operated as the image detection mode, and the state in which only the GPS rhythm detecting section 114 is operated as the GPS detection mode respectively. When a matter for setting is inputted, the input section 140 outputs a prespecified signal Sin to the processing section 170 for setting. The input section 140 is not limited to the configuration in which operation buttons, operation knobs and the like are provided therein, and for instance the input section 140 may have the configuration in which an input operation is performed with a touch panel provided on a display section 160 or with voices for setting various matters.

The audio output section 150 has a speaker (not shown) and provided, for instance, in any of an installment panel section, a door section, or a rear dashboard. This audio output section 150 outputs, under control of the processing section 170, an audio signal Sad such as the data for reproduction 61 from the processing section 170 with voices and sounds from a speaker.

The display section 160 is controlled by the processing section 170, and displays the image signal Sdp for image data from the processing section 170 on a screen thereof. The image data includes, but not limited to a name of a music being reproduced, a player's name, a period of time required for playing the music, sound volume and the like. As the display section 160, any of a liquid crystal panel, an organic EL (Electro Luminescence) panel, a PDP (Plasma Display Panel), a CRT (Cathode-Ray Tube), an FED (Field Emission Display), an electrophoretic display panel and the like may be used.

The processing section 170 comprises, various input/output ports (not shown) such as a rhythm detection port with the externally inputted rhythm detecting section 110 connected thereto, a storage port with the music data storing section 120 connected thereto, a memory port with the memory 130 connected thereto, an input port with the input section 140 connected thereto, an audio port with the audio output section 150 connected thereto, and a display port with the display section 160 connected thereto. Further the processing section 170 comprises, as various types of programs, as shown in FIG. 1, a music reproduction control section 171, a music rhythm detecting section 172, and a rhythm setting section 173. It is to be noted that the reproduction controller according to the present invention comprises the externally inputted rhythm detecting section 110 and the rhythm setting section 173.

The music reproduction control section 171 reproduces a music based on the music data 60*m* stored in the music data storing section 120. More specifically, the music reproduction control section 171 recognizes an input for setting reproduction of a music in response to an input operation in the input section 140 by a user. The music reproduction control section 171 acquires the music data 60*m* stored in the music data storing section 120 based on the input for setting. When the music rhythm information 65 is stored in the music data 60*m*, the music reproduction control section 171 converts the data for reproduction 61 to an audio signal Sad with a speed based on the rhythm described in the music rhythm information 65. Then the music reproduction control section 171 outputs this audio signal Sad to the audio output section 150. When the music rhythm information 65 is not stored in the music data 60*m*, the music reproduction control section 171 converts the data for reproduction 61 to the audio signal Sad with a preset speed. Then the music reproduction control section 171 outputs the audio signal Sad to the audio output section 150. Further the music reproduction control section 171 generates an image signal Sdp for displaying various types of information concerning a music being reproduced including a name of the music described in the music name information 63, a player described in the player information 64, a period of time required for playing the music. The music reproduction control section 171 outputs this image signal Sdp to the display section 160.

The music reproduction control section 171 acquires set rhythm information described below and generated by the rhythm setting section 173. Then, the music reproduction control section 171 sets a speed of outputting the data for reproduction 61, namely a speed of music reproduction based on the set rhythm information, and changes, for instance, rhythms such as BPM, beat of the music or the like according to the necessity. Then the music reproduction control section 171 reproduces the music with the rhythm having been changed in synchronism to the external rhythm.

Figure 14:
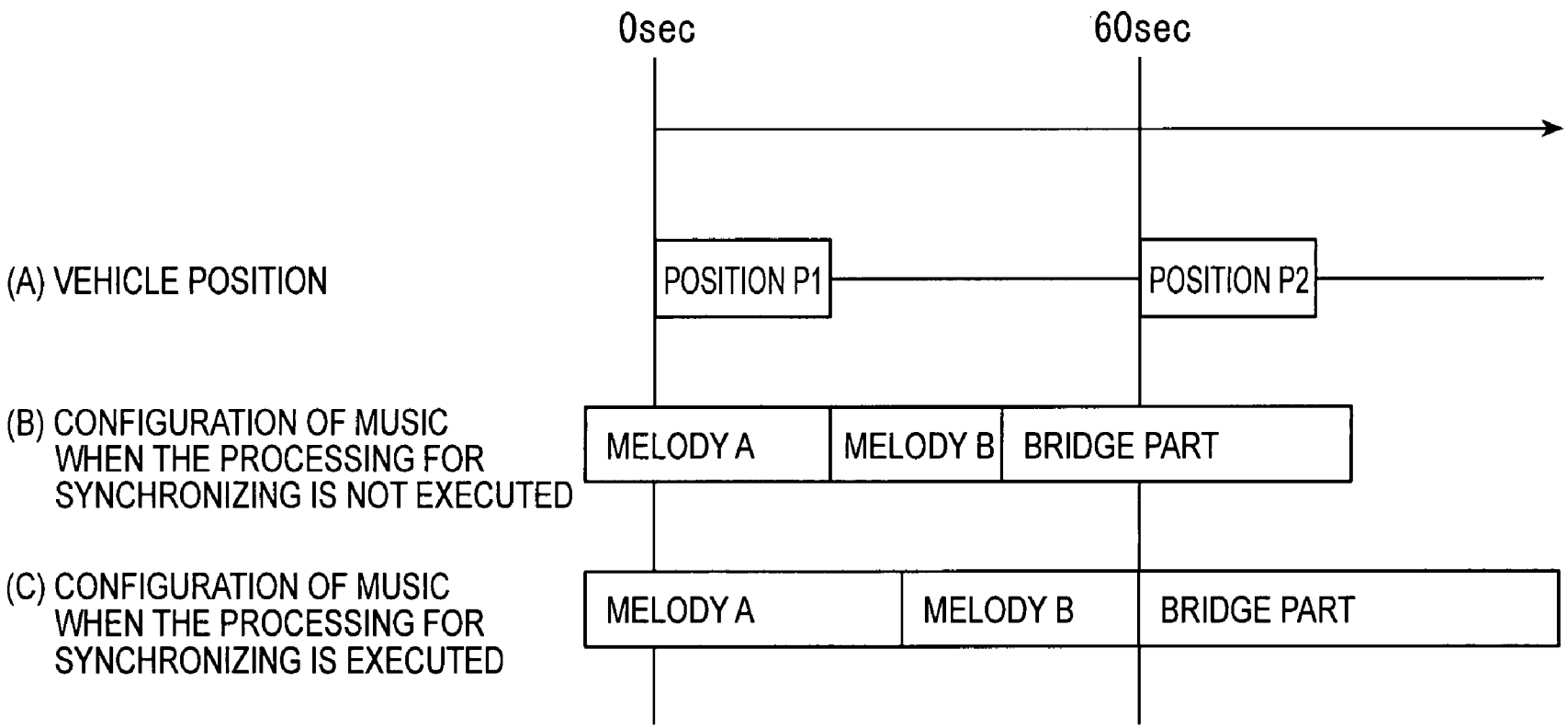
FIG. 14 is a timing chart showing an example of music reproduction state in the GPS detection mode in the embodiment above. More specifically, (A) shows a position of a vehicle, (B) shows configuration of music when the rhythm synchronizing processing is not executed, and (C) shows configuration of music when the rhythm synchronizing processing is executed.

The music reproduction control section 171 further recognizes a position of "bridge part" which is the most sensational section in a music comprising "melody A", "melody B", and "bridge part" (Refer to, for instance, (B) of FIG. 14) each as a specific section having a different tube with each other. As the method for recognizing the "bridge part" section in a music, for instance, there may be employed the method disclosed in the document entitled "Real Time Musical Scene Description System: Method of Detecting a "Bridge part" Section (Report by Information Processing Society of Japan, Musical Information Science Study Group Vol. 2002, No. 100, P.27-p.34), namely the method of recognizing a section repeated most often in a music as a "bridge part", but the present invention is not limited to this method. The music reproduction control section 171 sets a speed for reproducing the music based on the set rhythm information and changes a rhythm of the music according to the necessity. Then the music reproduction control section 171 reproduces the music with the rhythm changed so that timing for starting the "bridge part" is synchronized to a change in the scene. Descriptions herein assume the configuration in which the timing for starting reproduction of "bridge part" is synchronized to a change in a scene, but the present invention is not limited to this configuration, and also the configuration is allowable in which the timing for starting the "bridge part" is synchronized to a change in "Melody A" or "Melody B".

In the following descriptions, the processing for changing a rhythm of a music and the processing for synchronizing a music to an external rhythm are generically described as the music rhythm synchronizing processing. Details of the music rhythm synchronizing processing in the music reproduction control section 171 are described hereinafter.

The music rhythm detecting section 172 detects, for instance, rhythms such as BPM or beat of a music reproduced from the data for reproduction 61 in the music data 60*m* in which the music information 62 and music rhythm information 65 are not stored. Then the music rhythm detecting section 172 generates reproduced sound rhythm information with information concerning the detected rhythm described therein. More specifically, the music rhythm detecting section 172, acquires an audio signal Sad form the data for reproduction 61. Then the music rhythm detecting section 172 recognizes, for instance, a waveform of a music based on this audio signal Sad. Then the music rhythm detecting section 172 recognizes an interval between sections in which output of the music becomes relatively larger, namely peaks in the waveform of the music, and recognizes, for instance, rhythms such as BPM or beat of the music from the peak interval. Then the music rhythm detecting section 172 generates reproduced sound rhythm information describing rhythms of the music.

The rhythm setting section 173 generates set rhythm information concerning rhythms or other factors of a music to be set for synchronizing rhythms of the music to rhythms of external ones based on the reproduced sound rhythm information of music rhythm information 65 as well as on the external rhythm information. More specifically, the rhythm setting section 173 acquires the reproduced sound rhythm information generated by the music rhythm detecting section 172, or the music rhythm information 65 stored in the music data storing section 120. Then the rhythm setting section 173 recognizes, for instance, BPM or beat of the music being reproduced based on the acquired reproduced sound rhythm information or the music rhythm information 65. Further the rhythm setting section 173 acquires an external rhythm signal Sga from the externally inputted rhythm detecting section 110. Then the rhythm setting section 173 recognizes the external rhythm information based on the external rhythm signal Sga. Then the rhythm setting section 173 recognizes a rhythm of changes in BPM of the running sound or in a scene based on the external rhythm information. Then the rhythm setting section 173 recognizes the necessity of setting, for instance, BPM of the music being reproduced to a value matching the rhythm in changes of BPM of the running sound or in the scene for matching rhythms of the music to the external rhythm. Further, in order to synchronize the rhythms of the music to the external rhythm, the rhythm setting section 173 recognizes the timing for changing, for instance, BPM of the music being reproduced. Then the rhythm setting section 173 generates set rhythm information describing information concerning a value adjusted to the rhythm in changes of, for instance, BPM of the running sound or in a scene, information concerning timing for changing BPM of the music or the like.

[Operation of the Sound Reproducer]

Operations of the entire car audio system 100 are described below with reference to the related drawings.

(The Processing for Generating External Rhythm Information in the Running Sound Rhythm Detecting Section)

Figure 7:
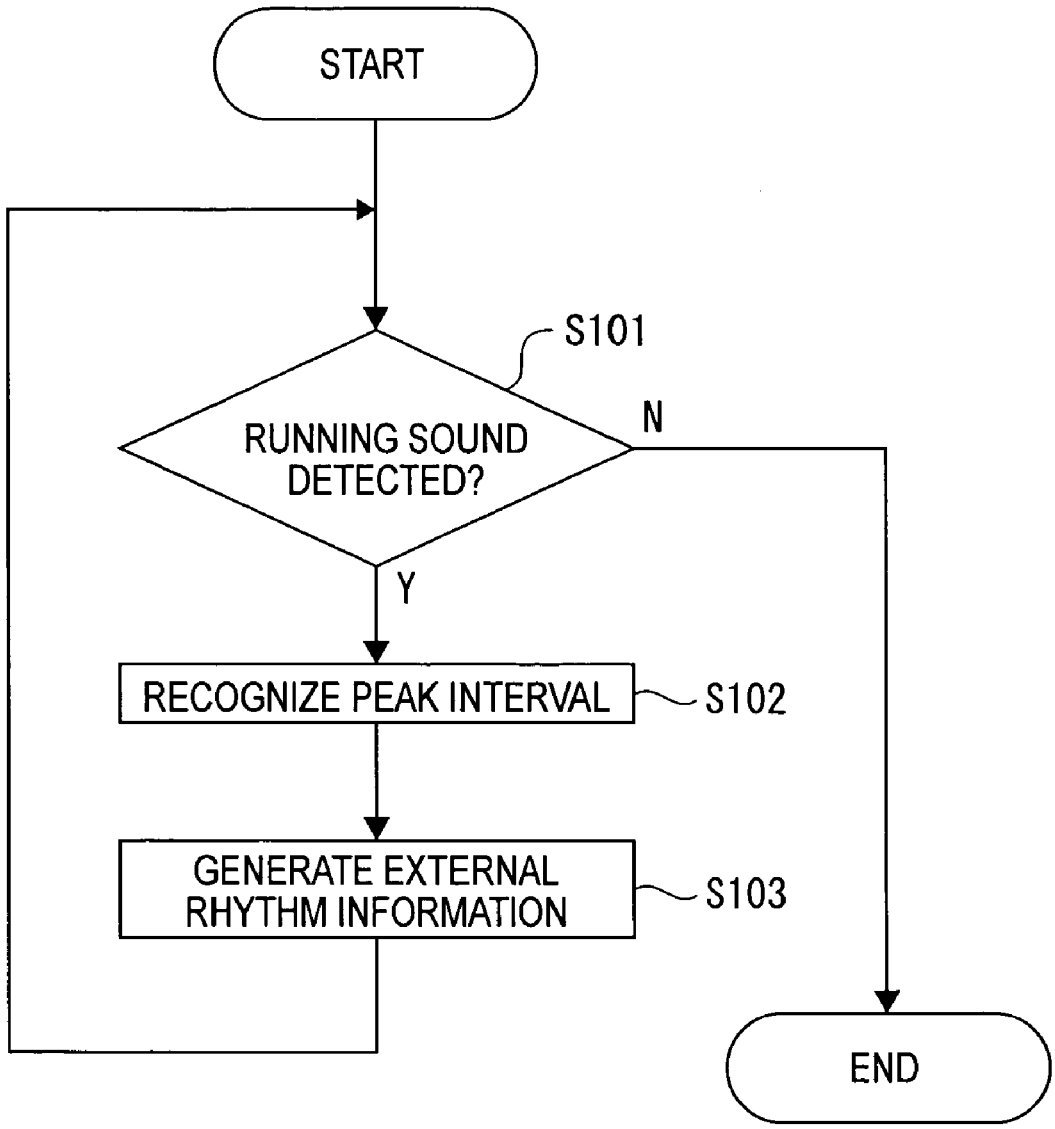
FIG. 7 is a flow chart showing the processing for generating external rhythm information in a running sound rhythm detecting section in the embodiment above.

At first, the processing for generating external rhythm information in the running sound rhythm detecting section 111 is described as an operation of the entire car audio system 100 with reference to FIG. 7. FIG. 7 is a flow chart showing the processing for generating the external rhythm information in the running sound rhythm detecting section.

At first, the externally inputted rhythm detecting section 110 in the entire car audio system 100 recognizes that the running sound detection mode has been effected. Then, as shown in FIG. 7, the running sound rhythm detecting section 111 determines whether a running sound has been detected by a running sound sensor in the sensor 200 or not (step S101). More specifically, the running sound rhythm detecting section 111 determines whether the running sound information has been acquired from the running sound sensor or not. In this step S101, when it is determined that the running sound has not been detected, the running sound rhythm detecting section 111 terminates the processing for generating external rhythm information.

In step S101, when it is determined that the running sound has been detected, the running sound rhythm detecting section 111 recognizes, for instance, a waveform of the running sound from the running sound information acquired in step S101. Then the running sound rhythm detecting section 111 recognizes a peak interval from this waveform (step S102). For instance, the running sound rhythm detecting section 111 recognizes, for instance, a waveform of the running sound as shown in FIG. 3 from the running sound information acquired in the step S101. So the running sound rhythm detecting section 111 recognizes that the peak interval in this waveform is 0.5 second.

The running sound rhythm detecting section 111 generates external rhythm information concerning a rhythm of the running sound (step S103), and returns to step S101. For instance, when the peak interval in the waveform of the running sound recognized in the step S102 is 0.5 second, the running sound rhythm detecting section 111 recognizes that BPM is 120. Then the running sound rhythm detecting section 111 generates the external rhythm information with the BPM described therein, and returns to the processing in step S101.

(Processing for Generating External Rhythm Information in the Vehicle Speed Pulse Rhythm Detecting Section)

Figure 8:
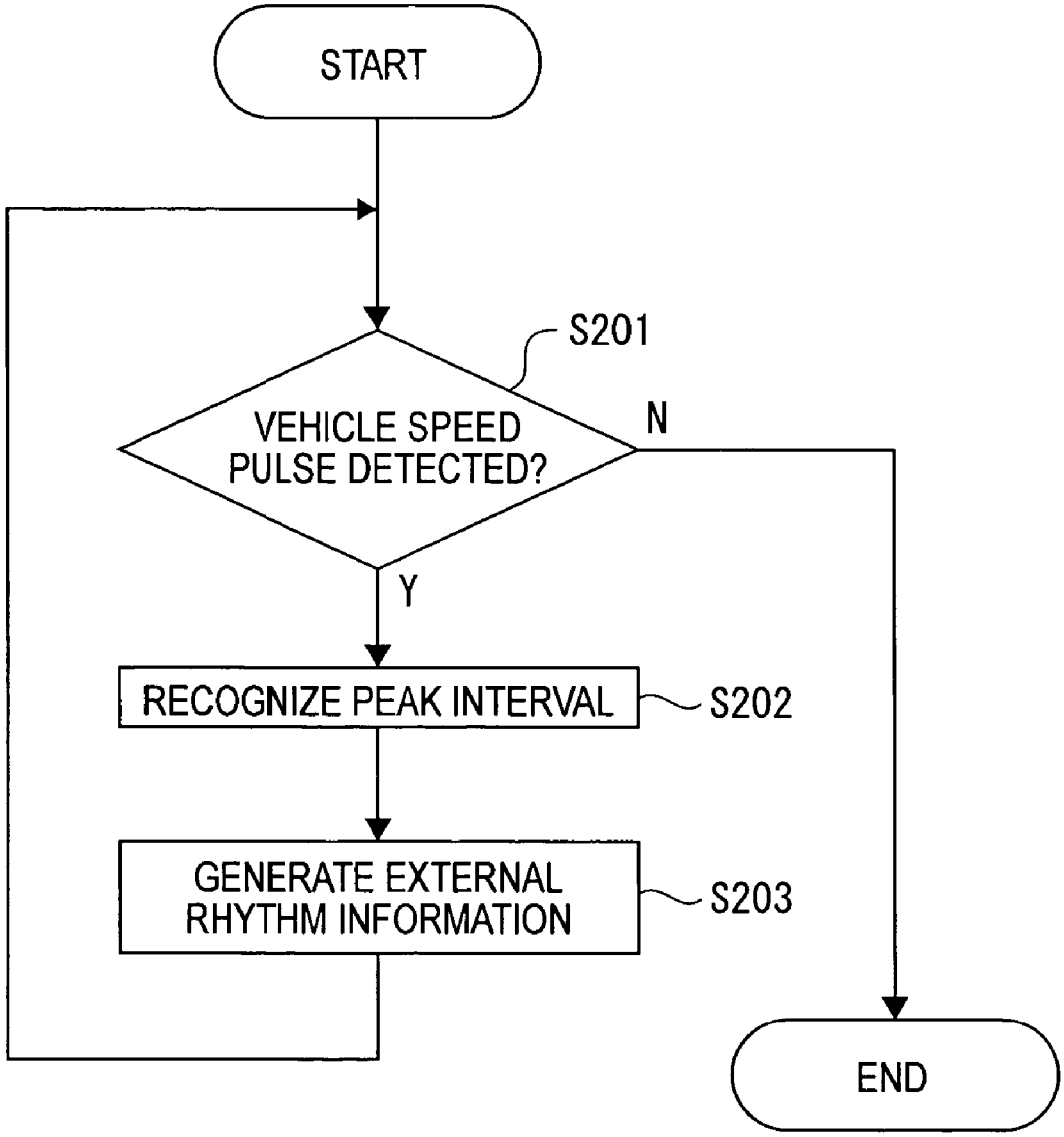
FIG. 8 is a flow chart showing the processing for generating external rhythm information in a vehicle speed pulse rhythm detecting section in the embodiment above.

The processing for generating external rhythm information in the vehicle speed pulse rhythm detecting section 112 is described below as an operation of the entire car audio system 100 with reference to FIG. 8. FIG. 8 is a flow chart showing the processing for generating external rhythm information in the vehicle speed pulse rhythm detecting section.

At first the externally inputted rhythm detecting section 110 in the entire car audio system 100 recognizes that the vehicle speed detection mode has been effected. Then as shown in FIG. 8, the vehicle speed pulse rhythm detecting section 112 determines that a vehicle speed pulse has been detected by a vehicle speed sensor in the sensor 200 (step S201). More specifically, the vehicle speed pulse rhythm detecting section 112 determines whether the speed pulse information has been acquired from the vehicle speed sensor or not. In this step S201, when the vehicle speed pulse has not been detected, the vehicle speed pulse rhythm detecting section 112 terminates the processing for generating external rhythm information.

On the other hand, when it is determined in step S201 that the vehicle speed pulse has been detected, the vehicle speed pulse rhythm detecting section 112 recognizes, for instance, a waveform of the vehicle speed pulse from the vehicle speed pulse information acquired in step S201. Then the vehicle speed pulse rhythm detecting section 112 recognizes a peak interval in this waveform (step S202).

Then the vehicle speed pulse rhythm detecting section 112 generates external rhythm information concerning a rhythm of the vehicle speed pulse (step S203), and returns to step S201. More specifically, the vehicle speed pulse rhythm detecting section 112 recognizes, for instance, BPM based on the peak interval in the waveform of the vehicle speed pulse recognized in step S202. Then the vehicle speed pulse rhythm detecting section 112 generates external rhythm information with the BPM described therein and returns to the processing in step S201.

(Processing for Generating External Rhythm Information in the Running Image Rhythm Detecting Section)

Figure 9:
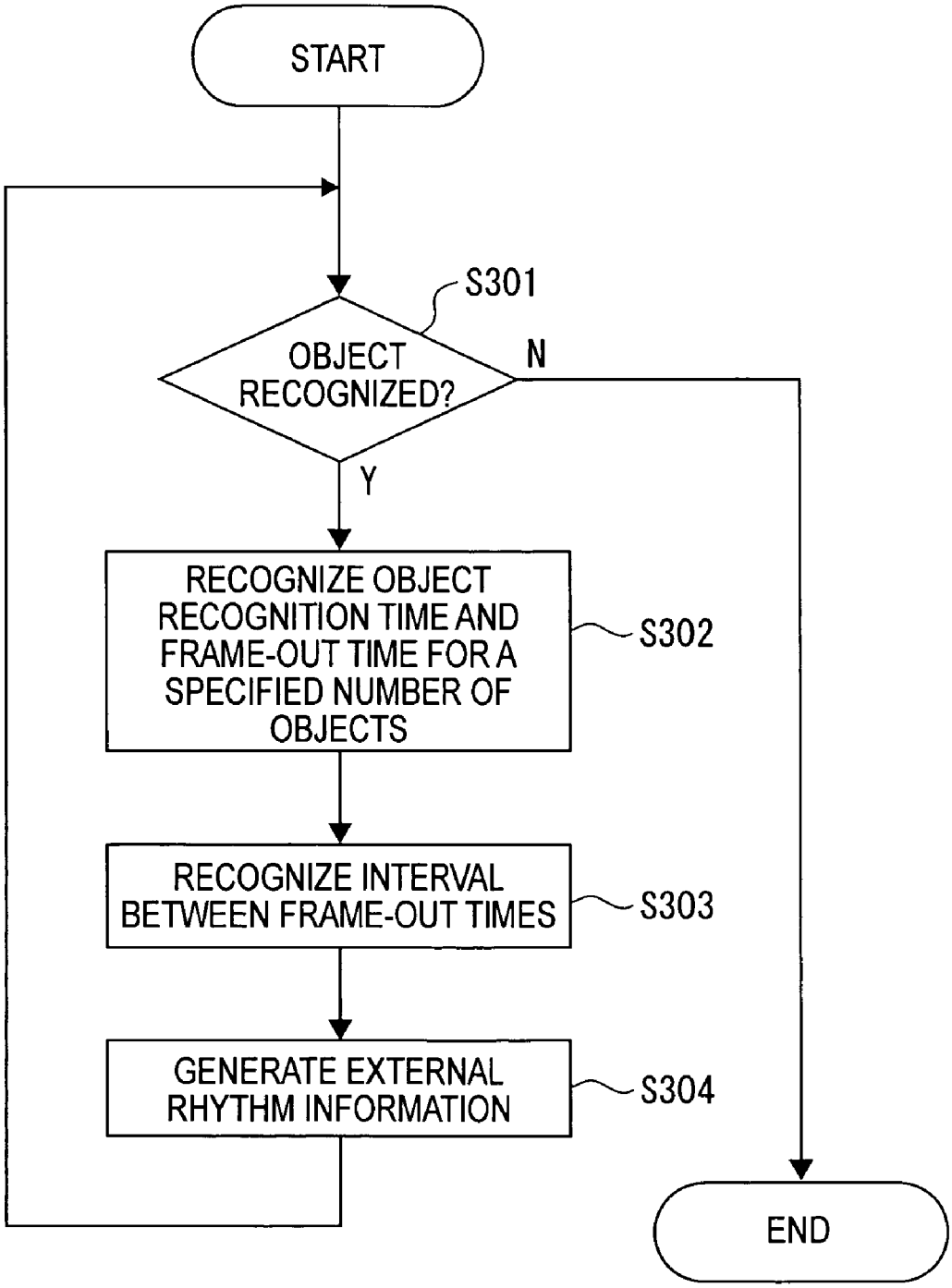
FIG. 9 is a flow chart showing the processing for generating external rhythm information in a running image rhythm detecting section in the embodiment above.

The processing for generating external rhythm information in the running image rhythm detecting section 113 is described as an operation of the entire car audio system 100 with reference to FIG. 9 and FIG. 10. FIG. 9 is a flow chart showing the processing for generating external rhythm information in the running image rhythm detecting section 113 FIG. 10 is a view showing a white line recognition start time and a frame-out time.

At first, the externally inputted rhythm detecting section 110 in the entire car audio system 100 recognizes that the image detection mode has been effected. Then as shown in FIG. 9, the running image rhythm detecting section 113 determines whether an object has been recognized or not (step S301). For instance, the running image rhythm detecting section 113 acquires, for instance, the running image information concerning the running image screen G1 as shown in FIG. 4A via a running image camera. The running image rhythm detecting section 113 determines, based on this running image information, whether the white line A is present in an object recognition range H on the running image screen G1 or not. When it is determined in step S301 that any object has not been, the running image rhythm detecting section 113 terminates the processing for generating external rhythm information.

On the other hand, in step S301, when it is determined that an object has been detected, the running image rhythm detecting section 113 recognizes the point of time when the object is recognized as the reference time. For instance, the running image rhythm detecting section 113 recognizes the time when the running image screen G1 as shown in FIG. 4A is recognized as the reference time. Then the running image rhythm detecting section 113 recognizes the times of recognition of any given number of objects, for instance, three objects and the frame-out time (step S302). For instance, when the running image screen G2 as shown in FIG. 4B is recognized in 0.2 second after the reference time, the running image rhythm detecting section 113 recognizes the object recognition time for the white line B within the object recognition range H as 0.2 second. When it is recognized that the white line A frames out in 0.5 second after the reference time, the running image rhythm detecting section 113 recognizes the frame-out time as 0.5 second. Then the running image rhythm detecting section 113 recognizes the object recognition time and frame-out time, for instance, for the white lines A, B, C as shown in FIG. 10.

Then the running image rhythm detecting section 113 recognizes an interval between frame-out times for the objects (step S303). For instance, the running image rhythm detecting section 113 recognizes in step S302 that the interval between frame-out times for the white lines A, B, C as shown in FIG. 10 is about 0.5 second. Descriptions herein assume the configuration in which an interval between frame-out times is recognized, but the present invention is not limited to this configuration, and also the configuration may be employed in which an interval between the recognition start times is recognized.

Then the running image rhythm detecting section 113 generates external rhythm information for a rhythm in object recognition (step S304), and returns to step S301. For instance, when the interval between the frame-out times recognized in step S303 is about 0.5 second, the running image rhythm detecting section 113 recognizes that BPM is 120. The running image rhythm detecting section 113 generates the external rhythm information with the BPM described therein and returns to the processing in step S301.

(Processing for Generating External Rhythm Information in the GPS Rhythm Detecting Section)

Figure 11:
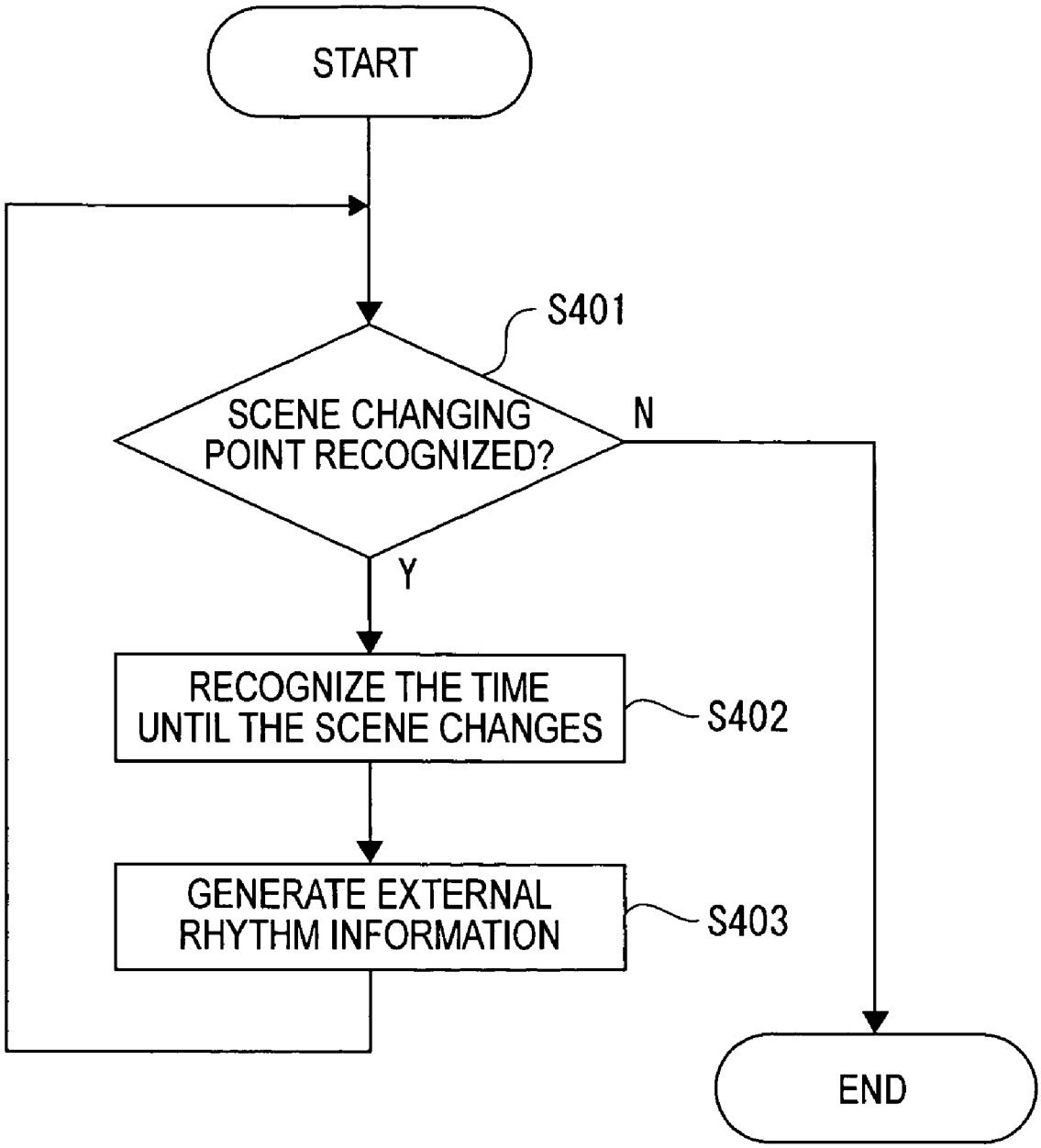
FIG. 11 is a flow chart showing the processing for generating external rhythm information in a GPS rhythm detecting section in the embodiment above.

Next the processing for generating external rhythm information in the GPS rhythm detecting section 114 is described as an operation of the entire car audio system 100 with reference to FIG. 11. FIG. 11 is a flow chart showing the processing for generating external rhythm information in the GPS rhythm detecting section 114.

At first, the externally inputted rhythm detecting section 110 in the entire car audio system 100 recognizes that the GPS detection mode has been effected. Then, as shown in FIG. 11, the GPS rhythm detecting section 114 determines whether there is any changing point in a scene is present or not (step S401). More specifically, the GPS rhythm detecting section 114 acquires, for instance, travel-related information indicating a route R or a position P1 of the vehicle as shown in FIG. 5A from the navigation system. Then the GPS rhythm detecting section 114 determines whether there is a changing point in the scene such as left-hand turn or running on a highway is present on this route R or not. When it is determined in step S401 that there is not changing point in the scene, the GPS rhythm detecting section 114 terminates the processing for generating external rhythm information.

When it is determined in step S401 that there is any changing point in the scene, the GPS rhythm detecting section 114 recognizes a period of time until the scene is changed (step S402). For instance, when the route R as shown in FIG. 5A is recognized, the GPS rhythm detecting section 114 determines that there is a changing point in the scene because the route R turns to the left. Then the GPS rhythm detecting section 114 recognizes the time required for travel from the current position P1 to a position P2 where the scene changes.

Then the GPS rhythm detecting section 114 generates external rhythm information concerning a rhythm of change in the scene (step S403), and returns to the processing in step S401. More specifically, the GPS rhythm detecting section 114 generates external rhythm information describing the time required for travel to the position P2 where the scene changes recognized in step S402, and then returns to step S401.

(Processing for Synchronizing a Rhythm of a Music in the Running Sound Detection Mode, Vehicle Speed Detection Mode, and Image Detection Mode)

Figure 12:
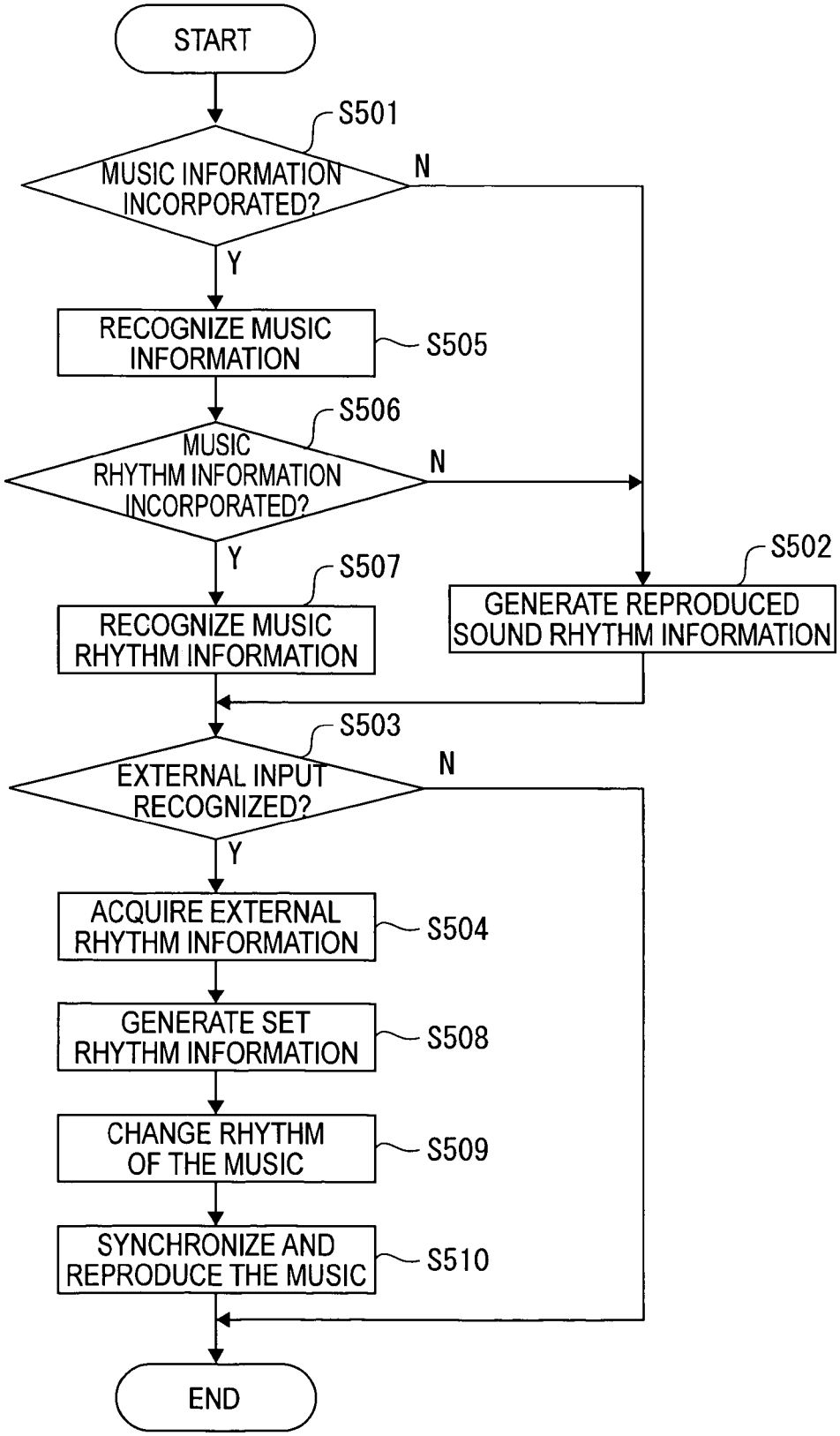
FIG. 12 is a flow chart showing the processing for synchronizing rhythm of a music in the embodiment above.
Figure 13:
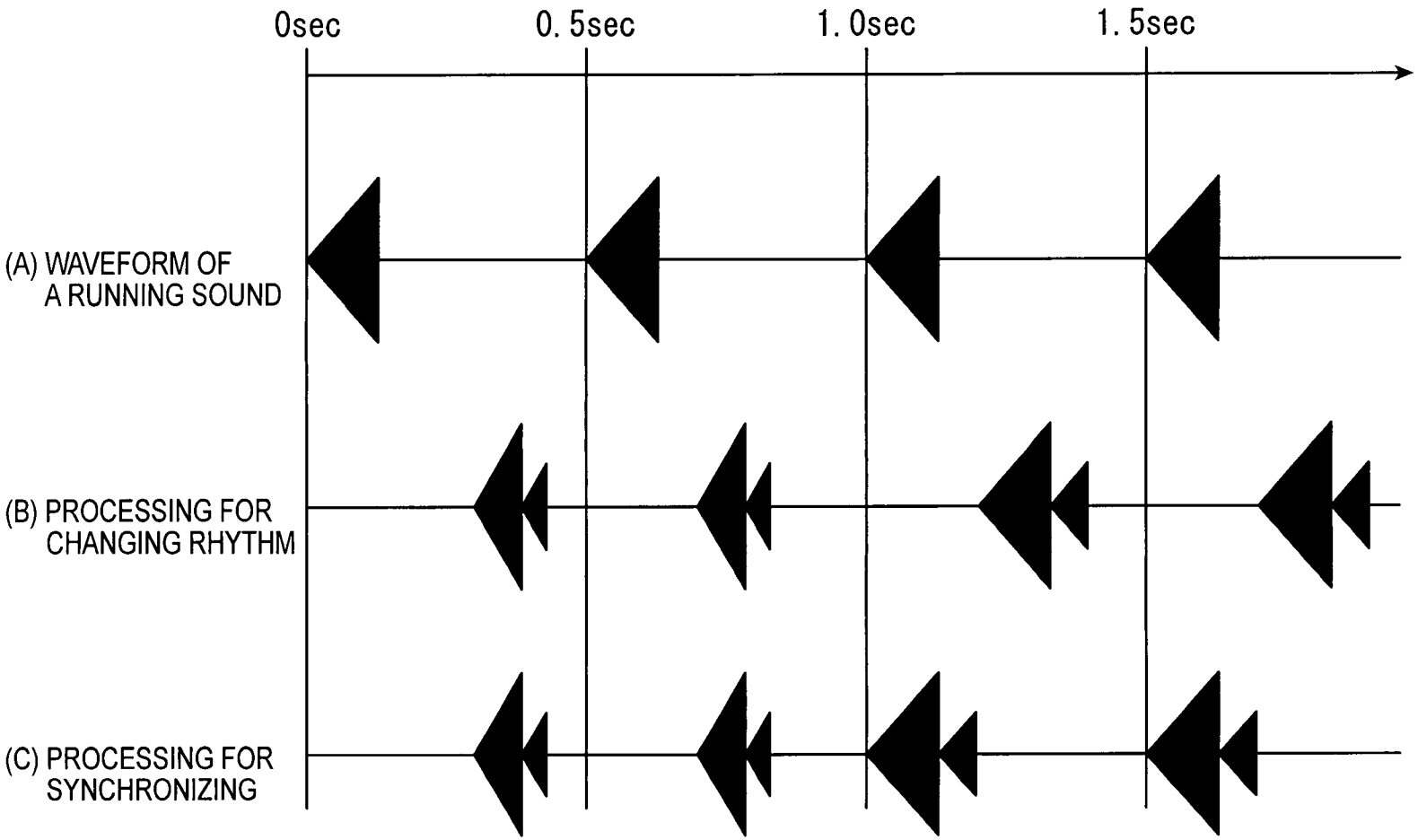
FIG. 13 is a timing chart showing an example of music reproduction state in a running sound detection mode, a vehicle speed detection mode, and an image detection mode. More specifically, (A) shows a waveform of a running sound, (B) shows the processing for changing rhythm, and (C); shows the synchronizing processing.

The processing for synchronizing a rhythm of a music in the running sound detection mode, vehicle speed detection mode, and image detection mode is described below as an operation of the entire car audio system 100 with reference to FIG. 12 and FIG. 13). FIG. 12 is a flow chart showing the processing for synchronizing a rhythm of a music. FIG. 13 is a timing chart showing examples of reproduction of a music in the running sound detection mode, vehicle speed detection mode, and image detection mode, and (A) shows a waveform of a running sound, (B) shows the processing for changing a rhythm, and (C) shows the synchronizing processing. In the following descriptions, the processing for synchronizing peaks in a waveform of a music to those in a waveform of an external rhythm is described as an example, but the present invention is not limited to this configuration, and for instance the configuration may be employed in which a beat or a head of a battuta of a music is synchronized to peaks in a waveform of an external rhythm.

At first, the entire car audio system 100 recognizes in response to an input operation by a user in the input section 140, in the state where a music is being reproduced, that any of the running sound detection mode, vehicle speed detection mode, and image detection mode has been effected. Then, as shown in FIG. 12, the processing section 170 in the entire car audio system 100 determines with the rhythm setting section 173 whether the music information 62 is incorporated in the music data 60*m* in which the data 61 for reproduction 61 for the music currently being reproduced is incorporated or not (step S501). More specifically, the rhythm setting section 173 recognizes the music data 60*m* acquired by the music reproduction control section 171 for reproducing the music. Then the rhythm setting section 173 determines whether the music information 62 has been incorporated in the music data 60*m* or not.

In this step S501, when the music information 62 is not incorporated in the music data 60*m*, the rhythm setting section 173 makes the music rhythm detecting section 172 recognize a rhythm of the music currently being reproduced. Then the rhythm setting section 173 makes the music rhythm detecting section 172 reproduce reproduced sound rhythm information concerning a rhythm of the music (step S502).

Then the rhythm setting section 173 determines, based on the running sound information and vehicle speed pulse information from the sensor 200 in the externally inputted rhythm detecting section 110 or the running image information from a running image camera, whether any external input corresponding to the detection mode currently being effected has been recognized or not (step S503). In this step S503, when it is determined that an external input has not been recognized by the externally inputted rhythm detecting section 110, the rhythm setting section 173 terminates the processing for synchronizing the rhythm of the music.

When it is determined in step S503 that an external input has been recognized by the externally inputted rhythm detecting section 110, the rhythm setting section 173 makes the externally inputted rhythm detecting section 110 execute the processing described above for generating external rhythm information concerning the external rhythm. Then the rhythm setting section 173 acquires external rhythm information from the externally inputted rhythm detecting section 110 (step S504). For instance, when the running sound detection mode has been effected, the rhythm setting section 173 makes the externally inputted rhythm detecting section 110 generate, for instance, external rhythm information describing that BPM is 120 from the peak interval in the waveform of the running sound as shown in (A) of FIG. 13 detected by the running sound rhythm detecting section 111. Then the rhythm setting section 173 acquires the external rhythm information. Also when the vehicle speed detection mode or image detection mode has been effected, the rhythm setting section 173 makes the vehicle speed pulse rhythm detecting section 112 or running image rhythm detecting section 113 generate external rhythm information describing a BPM value obtained from a peak interval in a waveform for a vehicle speed pulse and an interval between frame-out times. Then the rhythm setting section 173 acquires the external rhythm information.

When it is determined in step S501 that the music information 62 is incorporated in the music data 60*m*, the rhythm setting section 173 recognizes the music information 62 (step S505). Then the rhythm setting section 173 determines whether the music rhythm information 65 is incorporated in the music information 62 or not (step S506). When it is determined in step S506 that the music rhythm information 65 is not incorporated in the music information 62, the rhythm setting section 173 makes the music rhythm detecting section 172 execute the processing in step S502 to generate reproduced sound rhythm information.

On the other hand, when it is determined in step S506 that the music rhythm information 65 is incorporated in the music information 62, the rhythm setting section 173 recognizes the music rhythm information 65 (step S507). Then the rhythm setting section 173 executes the processing in step S503.

The rhythm setting section 173 generates set rhythm information when external rhythm information is acquired in step S504 (step S508). For instance, when the running sound detection mode has been effected, the rhythm setting section 173 recognizes BPM of the music currently being reproduced, for instance, based on the music rhythm information 65 recognized in step S507. Alternatively, based, for instance, on the external rhythm information concerning the running sound having the waveform as (A) in FIG. 13, the rhythm setting section 173 recognizes that BPM of the running sound is 120. Then, for instance, as shown in (C) of FIG. 13, the rhythm setting section 173 recognizes the timing for changing BPM of the music to synchronize peaks of the waveform of the music to those of the running sound in one second. Then the rhythm setting section 173 generates set rhythm information concerning a value of BPM of the running sound, and the timing for changing BPM of the music. Also when the vehicle speed detection mode has been effected, in order to synchronize peaks in the waveform of the music to those in the waveform of the vehicle speed pulse in a prespecified period of time, the rhythm setting section 173 recognizes the timing for changing BPM of the music. Then the rhythm setting section 173 generates set rhythm information describing a BPM value for the vehicle speed pulse and the information concerning the timing for changing the BPM of the music. Further the rhythm setting section 173 recognizes the timing for changing BPM of the music to synchronize each peak in the waveform of the music to a point of frame-out time in a preset period of time also when the image detection mode has been effected. The rhythm setting section 173 generates the set rhythm information describing the interval between frame-out times and the information concerning the timing for changing BPM of the music.

Then the processing section 170 changes, with the music reproduction control section 171, a rhythm of the music currently being reproduced so that the rhythm is synchronized to the external rhythm (step S509) based on the set rhythm information. For instance, when the running sound detection mode has been effected, the music reproduction control section 171 acquires the set rhythm information. Then the music reproduction control section 171 recognizes, based on the set rhythm information, that BPM of the running sound is 120. Then the processing section 170 sets a reproduction speed of the music so that the BPM of the music currently being reproduced is set to 120, which is the BPM of the running sound. Namely the processing section 170 sets the reproduction speed of the music so that the peak interval in the waveform of the music appearing in 1 second or longer is synchronized to that in the waveform of the running sound as shown in (A) of FIG. 13. Further also when the vehicle speed detection mode has been effected, the processing section 170 recognizes a BPM value of the vehicle speed pulse based on the set rhythm information. Then the processing section 170 sets the reproduction speed for the music so that BPM of the music currently being reproduced is synchronized to that of the vehicle speed pulse. Further, also when the image detection mode has been effected, the processing section 170 recognizes an interval between the frame-out times based on the set rhythm information. Then the processing section 170 sets a reproduction speed for the music so that the peak interval in the waveform of the music currently being reproduced is substantially the same as that of the frame-out interval.

The music reproduction control section 171 reproduces the music having been subjected to the rhythm change process in step S509 synchronizing the rhythm to the external rhythm (step S510). For instance, when the running sound detection mode has been effected, the music reproduction control section 171 recognizes the timing for changing BPM of the music based on the set rhythm information. Then the music reproduction control section 171 changes the reproduction speed for the music so that peaks in the waveform of the music appearing in 1 second or longer as shown in (B) of FIG. 13 appear in 1 second like the peaks in the waveform of the running sound as shown in (C) of FIG. 13. Further the music reproduction control section 171 changes the reproduction speed of the music so that, also when the vehicle speed detection mode has been effected, the peaks in the waveform of the music will appear at the same timing as that of the peaks in the waveform of the vehicle speed pulse. Further the music reproduction control section 171 changes the reproduction speed of the music so that, also when the image detection mode has been effected, peaks in the waveform of the music will appear at the same timing of the frame out. Then the processing section 170 terminates the rhythm synchronizing processing.

(Processing for Synchronizing a Rhythm of a Music in the GPS Detection Mode)

The processing for synchronizing a rhythm of a music in the GPS detection mode is described below as an operation of the entire car audio system 100 with reference to FIG. 12 and FIG. 14. FIG. 14 is a timing chart illustrating an example of reproducing state of a music in the GPS detection mode, in which (A) shows a position of a vehicle, (B) shows a configuration of a music when the rhythm synchronizing processing is not executed, and (C) shows a configuration of a music when the rhythm synchronizing processing is executed. Descriptions of the rhythm synchronizing processing in the GPS detection mode, which is similar to that in the running sound detection mode, vehicle speed detection mode, and image detection mode described above, is simplified below. Further descriptions herein assume a case in which the rhythm synchronizing processing in which reproduction of "bridge part" is started when a vehicle reaches the position where a scene changes to another, but the present invention is not limited to this configuration.

At first, the entire car audio system 100 recognizes in response to an input operation by a user in the input section 140, in the state where a music is being reproduced, that the GPS detecting mode has been effected. Then, as shown in FIG. 12, the processing section 170 in the entire car audio system 100 executes the processing in step S501 with the rhythm setting section 173. In this in step S501, when the rhythm setting section 173 determines that the music information 62 has not been incorporated in the music data 60*m*, the rhythm setting section 173 executes the processing in step S502.

Then the rhythm setting section 173 executes the processing in step S503. More specifically, the rhythm setting section 173 determines whether the GPS rhythm detecting section 114 recognizes an external input corresponding to the GPS detecting mode such as travel-related information from a navigation system. In step S503, when the rhythm setting section 173 determines that the GPS rhythm detecting section 114 has not recognized an external input, the rhythm setting section 173 terminates the rhythm synchronizing processing of the music.

On the other hand, in step S503, when the rhythm setting section 173 determines that the externally inputted rhythm detecting section 110 has recognized an external input, the rhythm setting section 173 executes the processing in step S504. More specifically, the rhythm setting section 173 makes the GPS rhythm detecting section 114 execute the processing described above to generate external rhythm information describing that, for instance, as shown in (A) of FIG. 14, time required for a vehicle to travel to the position P2 is 60 second. Then the rhythm setting section 173 acquires this external rhythm information.

The rhythm setting section 173 executes the processing in step S503 in step S501, when it determines that the music information 62 is incorporated in the music data 60*m* following the execution of the processing in step S505 or in step S507. Then the rhythm setting section 173 acquires the external rhythm information in step S504 and then executes the processing in step S508. For instance, the rhythm setting section 173 recognizes with the external rhythm information that time required for a vehicle to travel to the position P2 is 60 second. Then the rhythm setting section 173 recognizes, for instance, BPM of a music having a configuration, for instance, as shown in (B) of FIG. 14, based on reproduced sound rhythm information generated in step S502 or the music rhythm information 65 recognized in step S507. Then the rhythm setting section 173 computes, for instance as shown in (C) of FIG. 14, BPM of a music set for terminating reproduction of "melody B" in the music and starting reproduction of "bridge part" therein 60 second later. Further, in order to start reproduction of "bridge part" in the music 60 second later, the rhythm setting section 173 recognizes timing for changing BPM of the music. Then the rhythm setting section 173 generates set rhythm information describing a value of BPM for the music to be set and timing for changing BPM of the music.

After that, the processing section 170 executes the processing in step S509 with the music reproduction control section 171. Herein the music reproduction control section 171 acquires set rhythm information. Then the music reproduction control section 171 recognizes, based on the set rhythm information, a value of BPM for the music to be set. Then the music reproduction control section 171 sets a reproduction speed of the music so that the BPM of the music currently being reproduced is set to a value of the BPM recognized from the set rhythm information.

The music reproduction control section 171 then executes the processing in step S510. For instance, the music reproduction control section 171 recognizes the timing for changing BPM of a music based on the set rhythm information. The music reproduction control section 171 changes a reproduction speed of the music so that reproduction of "bridge part" of the music is started, as shown in (C) of FIG. 14, when a vehicle reaches the position P2 where a scene changes to another. Then the processing section 170 terminates the rhythm synchronizing processing.

As described above, in the embodiment described above, the car audio system 100 recognizes, based on running sound information from the sensor 200, the running sound in, for instance, the running sound rhythm detecting section 111 of the externally inputted rhythm detecting section 110. Then the car audio system 100 generates external rhythm information concerning this recognized running sound and outputs the external rhythm information. After that, the rhythm setting section 173 in the processing section 170 acquires the external rhythm information, and generates, based on this external rhythm information, set rhythm information for setting a rhythm of a music to that corresponding to the running sound. The music reproduction control section 171 then changes the reproduction speed, based on the set rhythm information, to set and reproduce the rhythm of a music to that corresponding to the running sound.

With this configuration, the car audio system 100 can set the rhythm of a music to that corresponding to the running situation from time to time, even when, for instance, the running situation of a vehicle changes. Therefore the car audio system 100 can reproduce a music in better condition corresponding to the external situation. Further a user can listen to a music having a rhythm corresponding to the external situation, and can also listen to the music comfortably.

The rhythm setting section 173 generates set rhythm information for setting a rhythm of a music to that corresponding to, for instance, a running sound or a running image which is changing associated with the travel of a vehicle. Thus the car audio system 100 can set a rhythm of a music to that corresponding to a running situation from time to time and reproduce it accordingly. Therefore the car audio system 100 can reproduce the rhythm of a music to that corresponding to the running situation and produce a further comfortable driving environment corresponding to the state of driving.

For instance, the GPS rhythm detecting section 114 generates external rhythm information concerning time required for a vehicle to reach the position P2 where a scene changes to another, and outputs the external rhythm information. The rhythm setting section 173 generates, based on this external rhythm information, set rhythm information for setting a rhythm of a music to that corresponding to the time required for a vehicle to reach to the position P2 where a scene changes to another. Thus the car audio system 100 can set the rhythm of the music corresponding to a change in scene from time to time, even when the scene changes to another while driving, and can reproduce an appropriate rhythm. Therefore, a user can listen to a music having a rhythm corresponding to a change in scene, and can also listen to the music comfortably.

The rhythm setting section 173 generates set rhythm information for setting a rhythm of a music to that corresponding to, for instance, a change of any running sound or the like from a recognizable state to an un recognizable state. Thus the car audio system 100 can set from time to time the rhythm of the music corresponding to a change in the external situation auditorily recognized by a user and can reproduce it accordingly. Therefore the user can listen to the music having a rhythm corresponding to a change in the auditorily recognized external situation, and can also listen to the music further comfortably.

The rhythm setting section 173 generates set rhythm information for setting a rhythm of a music to that corresponding to, for instance, a change of white lines A, B, C and the like from a visible state to an invisible state. Thus the car audio system 100 can set from time to time the rhythm of a music to that corresponding to a change in the external situation visually recognized by a user and can reproduce it accordingly. Therefore the user can listen to a music having a rhythm corresponding to a change in the visually recognized external situation, and can also listen to the music further comfortably.

The rhythm setting section 173 generates set rhythm information for setting, for instance, BPM of a music to that calculated from, for instance, a peak interval in a waveform of running sound. Thus the car audio system 100 can set from time to time the rhythm of the music to that corresponding to an interval of running sound recognized by a user. Therefore the user can listen to a music having an interval of output peaks substantially the same as that of the recognized running sound, and can also listen to the music further comfortably.

The rhythm setting section 173 generates set rhythm information concerning timing of changing, for instance, BPM of a music in order to synchronize a rhythm of a music with that of, for instance, running sound. Thus the car audio system 100 can synchronize from time to time the rhythm of the music with that of, for instance, running sound and can reproduce it. Therefore the user can listen to a music having an output peak substantially the same as timing of the recognized running sound, and can also listen to the music further comfortably.

The rhythm setting section 173 generates set rhythm information describing, for instance, BPM of a music to be set for starting reproduction of, for instance, "bridge part" in the music, when a vehicle reaches, for instance, the position P2 where a scene changes to another. Thus the car audio system 100 can terminate, when the vehicle reaches the position P2 where a scene changes to another, reproduction of "melody B" in the music and start reproduction of "bridge part" therein. Therefore, the car audio system 100 can reproduce a music in better condition corresponding to the external situation. Further a user can listen to an initial portion of "bridge part" having a different tune from that of "melody B", so that the user can enjoy listening to the music.

The car audio system 100 starts reproduction of "bridge part" in a music when a scene changes to another. Thus a user can listen to the most sensational portion of the music at the same time when a scene changes to another, so that the user can enjoy listening to the music more comfortably.

The music reproduction control section 171 changes a rhythm of a music by changing a reproduction speed. Thus the music reproduction control section 171 can change the rhythm of a music in such a simple way as only changing the reproduction speed of the music, and can quickly conduct the rhythm synchronizing processing of a music.

In the music data 60*m* used when the music reproduction control section 171 reproduces a music is incorporated the music rhythm information 65 indicating a rhythm of a music such as BPM and battuta. Thus the rhythm setting section 173 can recognize a rhythm of a music in such a simple way as only referring to the music rhythm information 65. Therefore the processing of generating set rhythm information can be quickly made, and the rhythm synchronizing processing of a music can be further quickly conducted.

The externally inputted rhythm detecting section 110 comprises rhythm detecting sections 111, 112, 113, 114 each detecting an external situation different with each other. Thus the car audio system 100 can reproduce a music having a rhythm corresponding to driving by, for instance, detecting the rhythm of a vehicle speed pulse with the vehicle speed pulse rhythm detecting section 112, even when, for instance, it is difficult for the running sound rhythm detecting section 111 to detect the rhythm of running sound. In addition, the car audio system 100 can reproduce a music having a rhythm corresponding to a change in various external situations. Therefore convenience of the car audio system 100 can be further enhanced.

The present invention has a configuration in which the input section 140 can change settings of each detection mode for detecting an external rhythm according to the necessity. Thus a user can listen to a music having a rhythm corresponding to a desired external rhythm according to the necessity. Therefore convenience of the car audio system 100 can be further enhanced.

[Variants of Embodiments]

It is to be noted that the present invention is not limited to the embodiments described above, but includes variants shown below within a scope in which the object of the present invention can be achieved.

Namely, a configuration in which a rhythm of a music is changed by changing a reproduction speed with the music reproduction control section 171, but the present invention is not limited to this configuration, and the present invention can be applied to, for instance, the following configuration. Namely, the present invention may have a configuration for changing a rhythm of a music, in which, for instance, data comprising the data for reproduction 61 is reproduced with a portion thereof omitted when BPM is made to be smaller, or data comprising the data for reproduction 61 is reproduced with mute data inserted thereto, for instance, at prespecified intervals when BPM is made to be larger. With the configuration as described above, it is possible to keep to a minimum a change in a pitch of a music or the like resulting from a change of a reproduction speed. Therefore a user can listen to the music further comfortably.

A configuration in which a rhythm of a music is synchronized with, for instance, that of running sound is exemplified above, but the configuration may be employed in which the rhythm of a music is not synchronized with that of running sound. With this configuration, it is possible to omit the processing in step S510. Therefore the processing of reproducing the rhythm of a music corresponding to the external rhythm can be conducted further quickly.

For instance, a configuration may be employed in which a rhythm of a music being reproduced is set so that reproduction of a music to be played next thereto is started, for instance, at the moment of, for instance, a peak in a waveform of running sound or a frame-out of an object, at the time when a scene changes to another or the like. With the configuration as described above, it is possible to synchronize a change in the external situation with a start of reproduction of the music. Therefore a user can further enjoy listening to the music.

For instance, a configuration may be employed in which a rhythm of a music being reproduced is set so that reproduction of "bridge part" in the music is started at the moment of, for instance, a peak in a waveform of running sound or a frame-out of an object. With the configuration as described above, it is possible for a user to listen to an initial portion of "bridge part" having a different tune from that of "melody B", so that the user can further enjoy listening to the music.

The configuration in which the input section 140 can change settings of each detection mode for detecting an external rhythm is exemplified according to the necessity, but the present invention is not limited to this configuration, and the present invention can be applied to, for instance, the following configuration. Namely, the present invention has a configuration in which an external rhythm is detected in each of the rhythm detecting sections 111, 112, 113, 114 from time to time, and the rhythm of a music is then changed corresponding to an external rhythm which is, for instance, most similar to or least similar to the rhythm of the music being reproduced. With the configuration as described above, it is possible for a user to listen to the music having a rhythm corresponding to the external rhythm without executing an input operation for setting each detecting mode. Therefore the user can easily enjoy listening to the music.

The configuration is exemplified in which the externally inputted rhythm detecting section 110 comprises the rhythm detecting sections 111, 112, 113, 114, but the present invention is not limited to this configuration, and the present invention can be applied to, for instance, a configuration in which at least any one of the rhythm detecting sections 111, 112, 113, 114 is provided. With the configuration as described above, it is possible to simplify the configuration of the externally inputted rhythm detecting section 110.

In a case where the data for reproduction 61 is configured in a multi-track system, a configuration may be employed in which, for instance, at least one of the trucks is put into the mute state corresponding to an external rhythm. With the configuration as described above, it is possible for a user to listen to the music having a change in melody or development corresponding to the external rhythm. Therefore the user can further enjoy listening to the music.

For instance, a reproduction controller according to the present invention is provided in a stationary type of a sound reproducer. The reproduction controller may have a configuration in which a music having a rhythm corresponding to a change in running sound of a bicycle or a train, operating sound of a washing machine, tapping sound of a keyboard of a portable or a desk-top personal computer (referred to as a PC hereinafter) or the like is reproduced. With the configuration as described above, it is possible for a user, for instance, at home to listen to the music having a rhythm v corresponding to the external rhythm and to listen to the music further comfortably. Therefore convenience of the stationary type of a sound reproducer can be further enhanced.

For instance, a reproduction controller according to the present invention is provided in a mobile type of a sound reproducer. The reproduction controller may have a configuration in which a music having a rhythm corresponding to running sound of a vehicle or a train, a rhythm of a heartbeat or a breath while a user is jogging or pedaling an exercise bike or the like is reproduced. With the configuration as described above, it is possible for a user, for instance, while traveling or during exercise to listen to the music having a rhythm corresponding to a change in the external situation and to listen to the music further comfortably. Therefore convenience of the mobile type of a sound reproducer can be further enhanced.

For instance, a reproduction controller according to the present invention is provided in a mobile or stationary type of a telephone. The reproduction controller may have a configuration in which a sound signaling an incoming call of the telephone is outputted having a rhythm corresponding to that of running sound of a vehicle or a train, a music being reproduced by a sound reproducer or the like is reproduced. With the configuration as described above, it is possible for a user while traveling or at home to listen to the sound signaling an incoming call having a rhythm corresponding to a change in the external situation and to listen to the sound signaling an incoming call further comfortably. Therefore convenience of the mobile or stationary type of a telephone can be further enhanced.

Additionally, a reproduction controller according to the present invention may be applied to any configuration in which reproduction of a music is controlled.

Descriptions herein assume a case in which each function described above is constructed as a program, but the present invention may have a configuration in which each function is configured with, for instance, hardware including a circuit board, or an element including one IC (Integrated Circuit), and any other forms may be employed. In addition, when the reproduction controller according to the present invention has a configuration in which each function is read from a program or other recording media, the reproduction controller can be handled easily, enabling an easy expansion of a use thereof.

Further, specific constructions and procedures in conducting the present invention can be changed to other constructions or the like according to the necessity within a scope in which the object of the present invention can be achieved.

[Advantages of the Embodiments]

As described above, in the above embodiments, the car audio system 100 recognizes an external situation such as, for instance, running sound with the externally inputted rhythm detecting section 110, and generates external rhythm information concerning this recognized running sound to output the external rhythm information. Then the rhythm setting section 173 in the processing section 170 acquires the external rhythm information, and generates, based on this external rhythm information, set rhythm information for setting a rhythm of a music to that corresponding to the running sound. Thus the car audio system 100 can set and reproduce, based on the set rhythm information, the rhythm of a music to that corresponding to the running situation from time to time, even when, for instance, the running situation of a vehicle changes. Therefore the car audio system 100 can reproduce a music in better condition corresponding to the external situation.

The priority application Number JP2004-029620 upon which this patent application is based is hereby incorporated by reference.

What is claimed is:

1. A reproduction controller for controlling reproduction of a music comprising;

a situation information generating section for recognizing an external situation that changes in accordance with a movement of a vehicle as a rhythm factor and generating external rhythm information based on the rhythm factor to output the external rhythm information; and a rhythm setting section for setting a reproduction rhythm of the reproduced music to the rhythm corresponding to the external situation based on the external rhythm information.

2. The reproduction controller according to claim 1, wherein said situation information generating section recognizes a change in said rhythm factor, generates the external rhythm information based on the recognized change in the rhythm factor, and outputs the external rhythm information.

3. The reproduction controller according to claim 2, wherein said change in the rhythm factor is a shift between a recognizable state and an unrecognizable state of any sound generated from the exterior.

4. The reproduction controller according to claim 2, wherein said change in the rhythm factor is a shift between a recognizable state and an unrecognizable state of any object existing in the exterior.

5. The reproduction controller according to claim 2, wherein said change in the situation rhythm factor is a change of the situation outside a moving body associated with movement of said moving body.

6. The reproduction controller according to claim 1, wherein said situation information generating section generates said external rhythm information from substantially same events occurring at substantially same intervals obtained by recognizing said rhythm factor, and outputs the external rhythm information; and wherein said rhythm setting section sets a reproduction rhythm of said reproduced music to the rhythm corresponding to said substantially same intervals based on said external rhythm information.

7. The reproduction controller according to claim 6, wherein said rhythm setting section synchronizes a reproduction rhythm of said reproduced music with said substantially same intervals.

8. The reproduction controller according to claim 1, wherein reproduction data for reproducing said music is correlated with music rhythm information concerning a reproduction rhythm of said music, and wherein said rhythm setting section recognizes a reproduction rhythm of said music based on said music rhythm information, and sets the recognized reproduction rhythm of said music to the rhythm corresponding to said rhythm factor.

9. The reproduction controller according to claim 8, wherein said music rhythm information has peak interval information concerning intervals of a portion in which output of the music relatively becomes larger, and wherein said rhythm setting section recognizes intervals of a portion in which output of said music relatively becomes larger based on said peak interval information, and sets said recognized intervals to a rhythm corresponding to said rhythm factor.

10. The reproduction controller according to claim 1, wherein the rhythm factor is running sound of the vehicle.

11. The reproduction controller according to claim 1, wherein the rhythm factor is a speed of the vehicle.

12. The reproduction controller according to claim 1, wherein the rhythm factor is an image recognized by a driver of the vehicle.

13. The reproduction controller according to claim 1, wherein a plurality of the rhythm factors, including at least running sound of the vehicle and speed of the vehicle, are recognized, and the reproduction controller includes a rhythm factor setting section for selecting one of the plurality of rhythm factors.

14. A reproduction control method for controlling reproduction of a music comprising the steps of:

recognizing an external situation that changes in accordance with a movement of a vehicle as a rhythm factor and generating external rhythm information based on the rhythm factor to output the external rhythm information; and setting a reproduction rhythm of the reproduced music to the rhythm corresponding to the external situation based on the external rhythm information.

15. A recording medium with a reproduction control program stored therein in a readable state with a computing section, wherein the program make the computing section to function as a reproduction controller for controlling reproduction of a music, the reproduction controller comprising;

a situation information generating section for recognizing an external situation that changes in accordance with a movement of a vehicle as a rhythm factor and generating external rhythm information based on the rhythm factor to output the external rhythm information; and a rhythm setting section for setting a reproduction rhythm of said reproduced music to the rhythm corresponding to the rhythm factor based on the external rhythm information.

16. A recording medium with a reproduction control program stored therein in a readable state with a computing section, wherein the program executing a reproduction control method for controlling reproduction of a music by the computing section, the method comprising the steps of:

recognizing an external situation that changes in accordance with a movement of a vehicle as a rhythm factor and generating external rhythm information based on the rhythm factor to output the external rhythm information; and setting a reproduction rhythm of the reproduced music to the rhythm corresponding to the external situation based on the external rhythm information.

* * * * *